US008382536B2

(12) United States Patent
Kuriyagawa et al.

(10) Patent No.: US 8,382,536 B2
(45) Date of Patent: Feb. 26, 2013

(54) OUTBOARD MOTOR CONTROL APPARATUS

(75) Inventors: Koji Kuriyagawa, Saitama (JP); Hajime Yoshimura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 369 days.

(21) Appl. No.: 12/760,273

(22) Filed: Apr. 14, 2010

(65) Prior Publication Data

US 2010/0267296 A1 Oct. 21, 2010

(30) Foreign Application Priority Data

Apr. 17, 2009 (JP) ..... 2009-101157
Apr. 17, 2009 (JP) ..... 2009-101158
Apr. 17, 2009 (JP) ..... 2009-101159
Apr. 17, 2009 (JP) ..... 2009-101160

(51) Int. Cl.
*B63H 21/22* (2006.01)

(52) U.S. Cl. ..... 440/1; 440/53; 440/75

(58) Field of Classification Search ..... 440/1, 53, 440/75

See application file for complete search history.

(56) References Cited

U.S. PATENT DOCUMENTS 5,002,147 A * 3/1991 Tezuka et al. ..... 180/197
6,959,239 B2 * 10/2005 Williams et al. ..... 701/55
2004/0139903 A1 7/2004 Watabe et al.
2006/0052013 A1 * 3/2006 Takada et al. ..... 440/1
2007/0077829 A1 * 4/2007 Boning ..... 440/1
2007/0089661 A1 4/2007 Yazaki et al.
2008/0210148 A1 9/2008 Mizutani
2009/0117788 A1 * 5/2009 Kaji ..... 440/1

FOREIGN PATENT DOCUMENTS

JP 59-160698 A 9/1984
JP 1-60997 U 4/1989
JP 6-144373 A 5/1994
JP 2006-077607 A 3/2006
JP 2007-315496 A 12/2007
JP 2007-315498 A 12/2007
JP 2008-254641 A 10/2008

* cited by examiner

*Primary Examiner* — Stephen Avila

(74) *Attorney, Agent, or Firm* — Carrier Blackman & Associates, P.C.; Joseph P. Carrier; William D. Blackman

(57) ABSTRACT

In an apparatus for controlling operation of an outboard motor mounted on a boat and having a torque converter equipped with a lockup clutch, it is configured to regulate a trim angle relative to the boat by trim-up operation and trim-down operation; calculate a speed ratio of the torque converter based on an input rotation speed and output rotation speed of the torque converter; and control operation of the trim angle regulator based on the calculated speed ratio. With this, it becomes possible to mitigate a deceleration feel to be generated after the acceleration is completed, and easily sets a trim angle of after the trim-up operation to an optimal value.

14 Claims, 20 Drawing Sheets

OUTBOARD MOTOR CONTROL APPARATUS

BACKGROUND OF THE INVENTION

1. Field of the Invention

This invention relates to an outboard motor control apparatus, particularly to an apparatus for controlling an outboard motor having a torque converter.

2. Description of the Related Art

In recent years, there is proposed an outboard motor having a torque converter interposed between an internal combustion engine and drive shaft to amplify output torque of the engine and then transmit it to the drive shaft for enhancing acceleration performance, etc., as taught, for example, by Japanese Laid-Open Patent Application No. 2007-315498 ('498). In this conventional technique, the torque converter includes a lockup clutch.

SUMMARY OF THE INVENTION

The outboard motor having the torque converter as in the reference is configured so that, upon the completion of acceleration, the lockup clutch is made ON (engaged) to prevent loss in transmittance of the engine output caused by slippage of the torque converter. However, when the lockup clutch is made ON, the torque is not amplified by the torque converter, resulting in the decrease of torque to be transmitted. As a result, the operator has a deceleration feel.

Although, to cope with the above problem, a configuration can be considered which, before the lockup clutch is made ON, regulates a trim angle to a predetermined angle by trimming up the outboard motor so that the thrust of the boat is increased to increase the boat speed, thereby mitigating the deceleration feel, it is necessary for this configuration to set the predetermined angle beforehand in accordance with the size of the boat, which is bothersome. In addition, when the set predetermined angle is not appropriate for the boat, it may disadvantageously cause the pitching (vibration or shake in the vertical direction) of the boat.

An object of this invention is therefore to overcome the foregoing drawbacks by providing an apparatus for controlling an outboard motor having a torque converter, which apparatus can mitigate a deceleration feel to be generated after the acceleration is completed, and easily sets a trim angle of after the trim-up operation to an optimal value.

In order to achieve the object, in a first aspect, this invention provides an apparatus for apparatus for controlling operation of an outboard motor mounted on a stern of a boat and having an internal combustion engine to power a propeller, a drive shaft connecting the engine and the propeller, and a torque converter equipped with a lockup clutch and interposed between the engine and the drive shaft, comprising: a trim angle regulator that regulates a trim angle relative to the boat by trim-up operation and trim-down operation; a speed ratio calculator that calculates a speed ratio of the torque converter based on an input rotation speed and output rotation speed of the torque converter; and a trim angle regulator controller that controls operation of the trim angle regulator based on the calculated speed ratio.

In order to achieve the object, in a second aspect, this invention provides a method of controlling operation of an outboard motor mounted on a stern of a boat and having an internal combustion engine to power a propeller, a drive shaft connecting the engine and the propeller, and a torque converter equipped with a lockup clutch and interposed between the engine and the drive shaft, comprising steps of: regulating a trim angle relative to the boat by trim-up operation and trim-down operation; calculating a speed ratio of the torque converter based on an input rotation speed and output rotation speed of the torque converter; and controlling the regulating based on the calculated speed ratio.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

Preferred embodiments of an outboard motor control apparatus according to the invention will now be explained with reference to the attached drawings.

Figure 1:
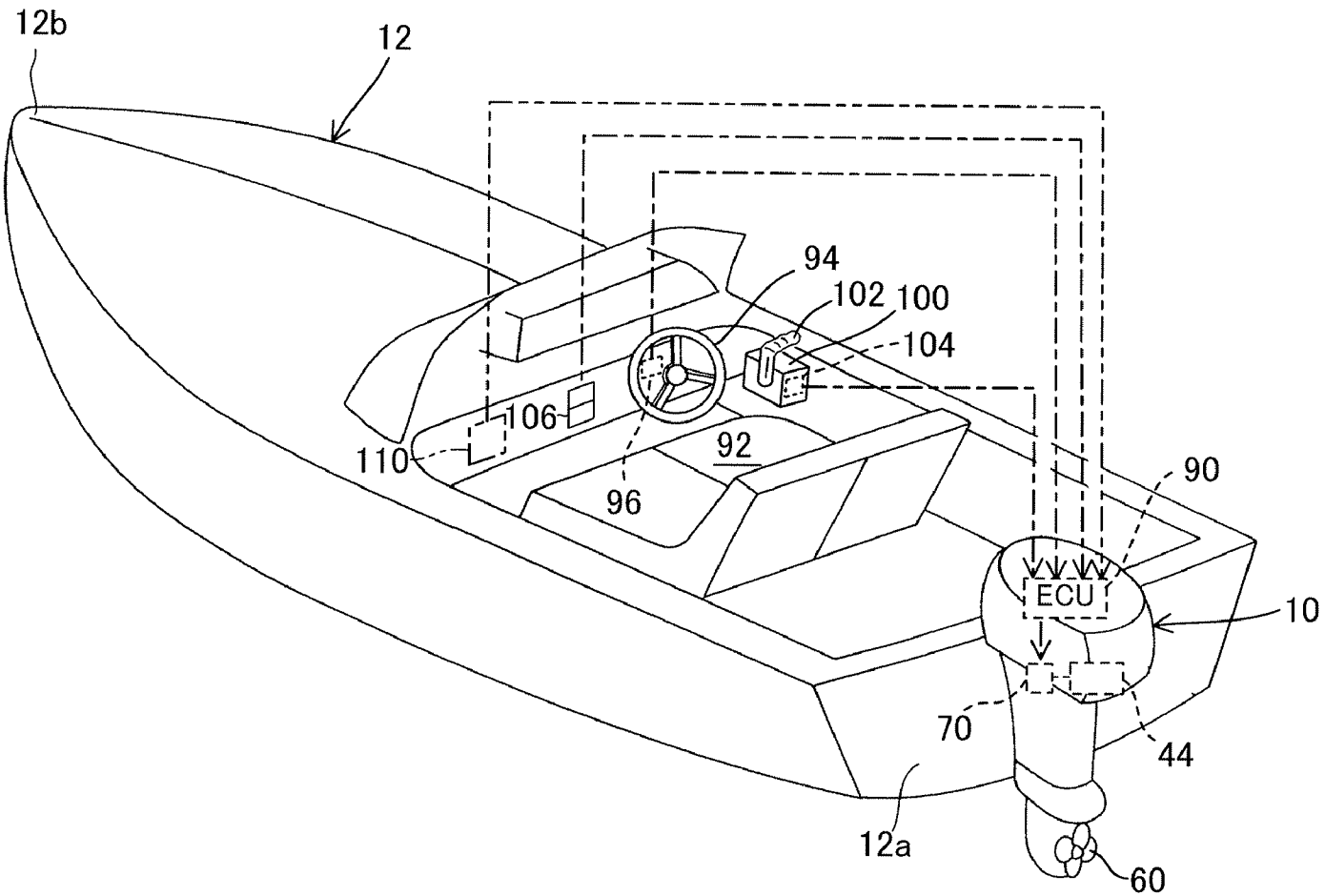
FIG. 1 is an overall schematic view of an outboard motor control apparatus including a boat (hull) according to a first embodiment of the invention.
Figure 2:
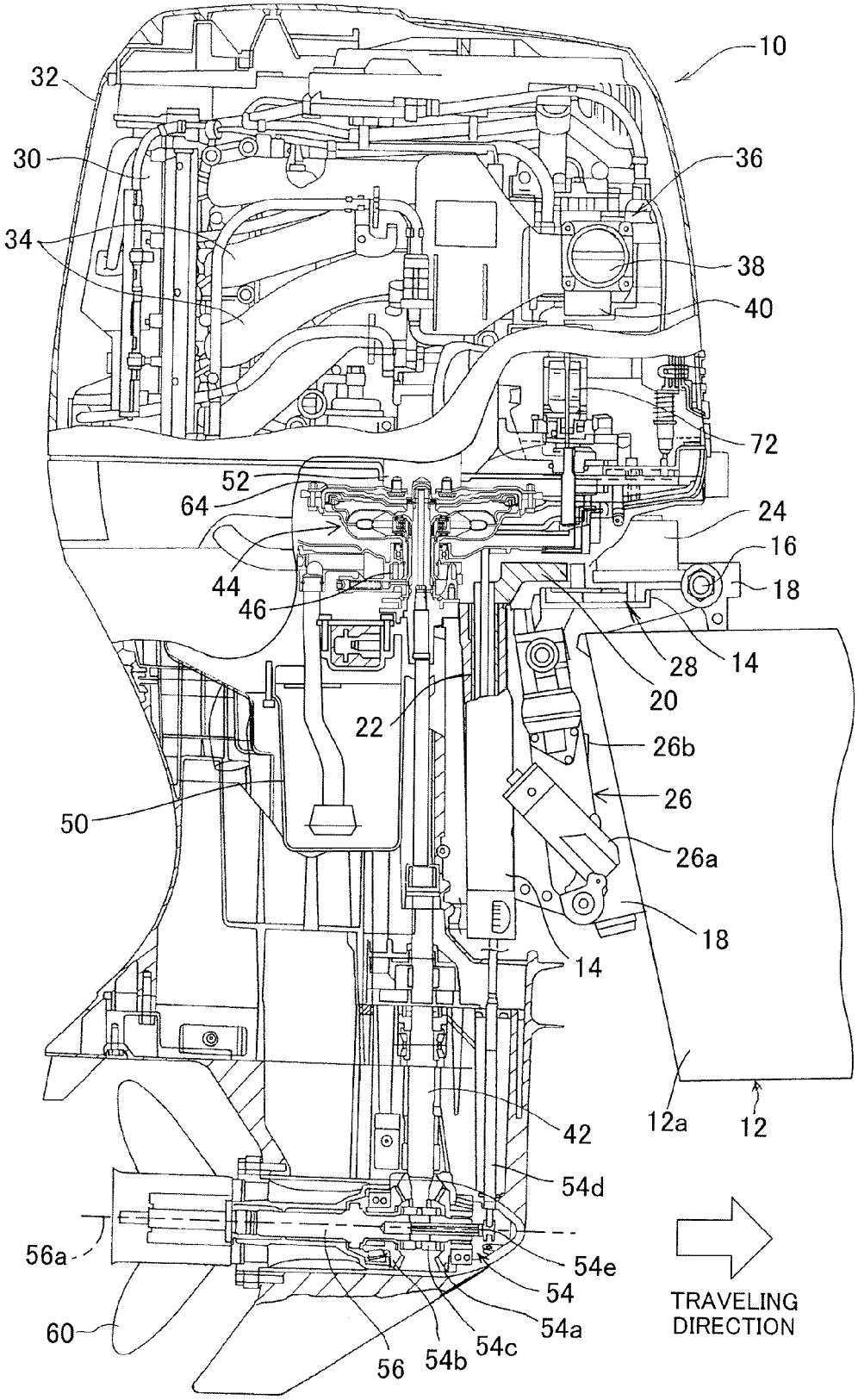
FIG. 2 is an enlarged sectional side view partially showing the outboard motor shown in FIG. 1.

FIG. 1 is an overall schematic view of an outboard motor control apparatus including a boat (hull) according to a first embodiment of the invention. FIG. 2 is an enlarged sectional side view partially showing the outboard motor shown in FIG. 1 and FIG. 3 is an enlarged side view of the outboard motor.

Figure 3:
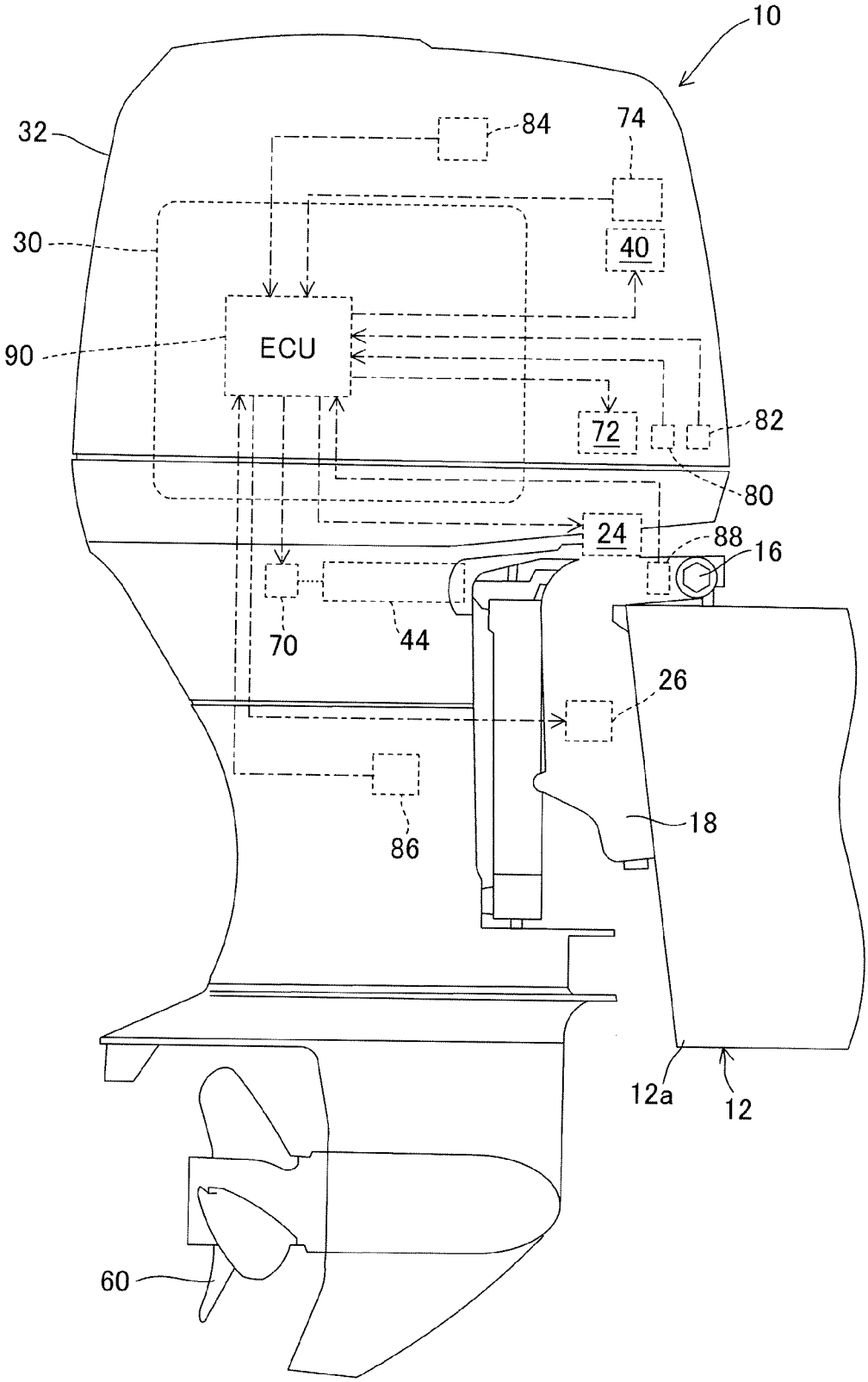
FIG. 3 is an enlarged side view of the outboard motor shown in FIG. 1.

In FIGS. 1 to 3, a symbol 10 indicates an outboard motor. As illustrated, the outboard motor 10 is clamped (fastened) to the stern or transom 12*a* of a boat (hull) 12.

As shown in FIG. 2, the outboard motor 10 is fastened to the boat 12 through a swivel case 14, tilting shaft 16 and stern brackets 18. The outboard motor 10 is equipped with a mount frame 20 and shaft 22. The shaft 22 is housed in the swivel case 14 to be rotatable about the vertical axis such that the outboard motor 10 can be rotated about the vertical axis relative to the boat 12. The mount frame 20 is fixed at its upper end and lower end to a frame (not shown) constituting a main body of the outboard motor 10.

An electric steering motor (actuator) 24 for operating the shaft 22 and a power tilt-trim unit (trim angle regulation mechanism) 26 for regulating a tilt angle and trim angle of the outboard motor 10 relative to the boat 12 by tilting up/down and trimming up/down are installed near the swivel case 14. A rotational output of the steering motor 24 is transmitted to the shaft 22 via a speed reduction gear mechanism 28 and the mount frame 20, whereby the outboard motor 10 is steered about the shaft 22 as a steering axis to the right and left directions (steered about the vertical axis).

The power tilt-trim unit 26 integrally comprises a hydraulic cylinder 26*a* for adjusting the tilt angle and a hydraulic cylinder 26*b* for adjusting the trim angle. When the power tilt-trim unit 26 operates the hydraulic cylinders 26*a*, 26*b* to extend and contract in accordance with a tilt-up/down signal and trim-up/down signal, the swivel case 14 is rotated about the tilting shaft 16 as a rotational axis, thereby tiling up/down and trimming up/down the outboard motor 10. The hydraulic cylinders 26*a*, 26*b* are connected to a hydraulic circuit (not shown) in the outboard motor 10 and extended/contracted upon being supplied with operating oil. The power tilt-trim unit 26 is operated using a duty ratio (i.e., PWM-controlled), and its operation speed, i.e., the speed of tiling up/down and trimming up/down is variable in stages or continuously.

An internal combustion engine (hereinafter referred to as the "engine") 30 is disposed in the upper portion of the outboard motor 10. The engine 30 comprises a spark-ignition, water-cooling gasoline engine with a displacement of 2,200 cc. The engine 30 is located above the water surface and covered by an engine cover 32.

An intake pipe 34 of the engine 30 is connected to a throttle body 36. The throttle body 36 has a throttle valve 38 installed therein and an electric throttle motor (actuator) 40 for opening and closing the throttle valve 38 is integrally disposed thereto.

The output shaft of the throttle motor 40 is connected to the throttle valve 38 via a speed reduction gear mechanism (not shown). The throttle motor 40 is operated to open and close the throttle valve 38, thereby regulating the flow rate of the air sucked in the engine 30 to control the engine speed.

The outboard motor 10 further comprises a drive shaft (vertical shaft) 42 installed parallel to the vertical axis to be rotatably supported, a torque converter 44 interposed between the engine 30 and drive shaft 42, a hydraulic pump 46 that is attached to the drive shaft 42 and pumps the operating oil to a lubricated portion of the engine 30, the power tilt-trim unit 26, the torque converter 44 and the like, and a reservoir 50 for reserving the operating oil.

The upper end of the drive shaft 42 is connected to a crankshaft 52 of the engine 30 through the torque converter 44 and the lower end thereof is connected via a shift mechanism 54 with a propeller shaft 56 supported to be rotatable about the horizontal axis. The propeller shaft 56 is positioned so that its axis line 56*a* is substantially parallel to the traveling direction of the boat 12 in the initial condition of the power tilt-trim unit 26 (condition where the trim angle is at the initial angle). One end of the propeller shaft 56 is attached with a propeller 60. Thus the drive shaft 42 connects the engine 30 with the propeller 60.

Figure 4:
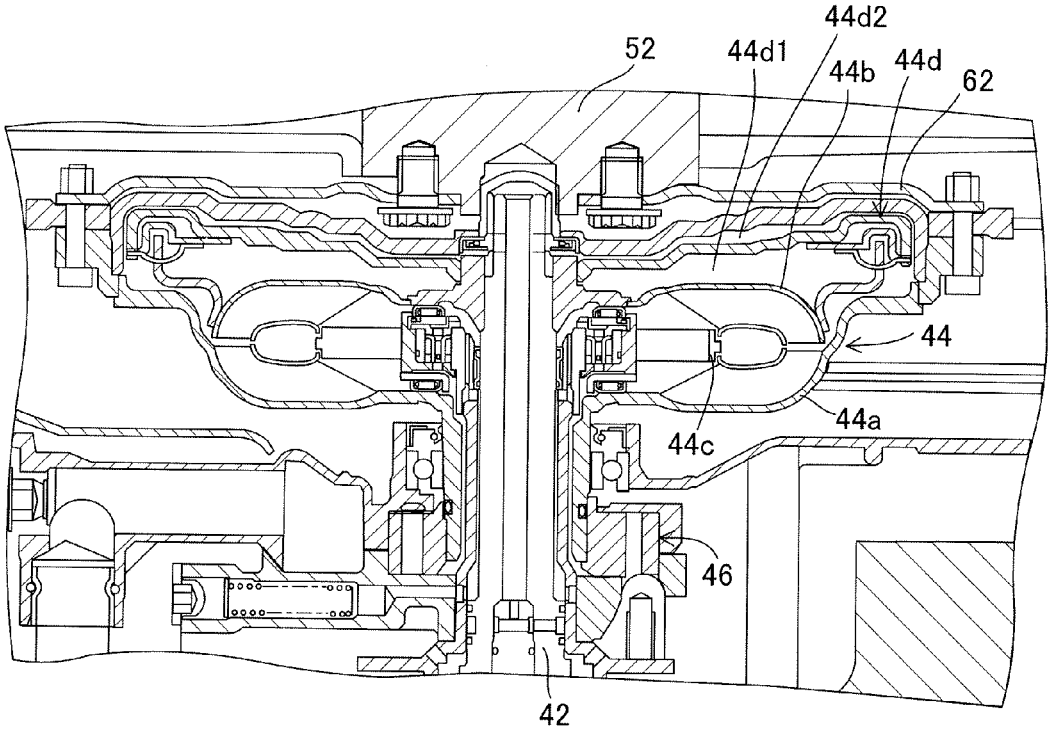
FIG. 4 is an enlarged sectional view showing a region around a torque converter shown in FIG. 2.

FIG. 4 is an enlarged sectional view showing a region around the torque converter 44 shown in FIG. 2.

As shown in FIG. 4, the torque converter 44 includes a pump impeller 44*a* connected to the crankshaft 52 through a drive plate 62, a turbine runner 44*b* that is installed to face the pump impeller 44*a* to receive/discharge the operating oil and connected to the drive shaft 42, a stator 44*c* installed between the pump impeller 44*a* and turbine runner 44*b*, a lockup clutch 44*d* and other components.

Figure 5:
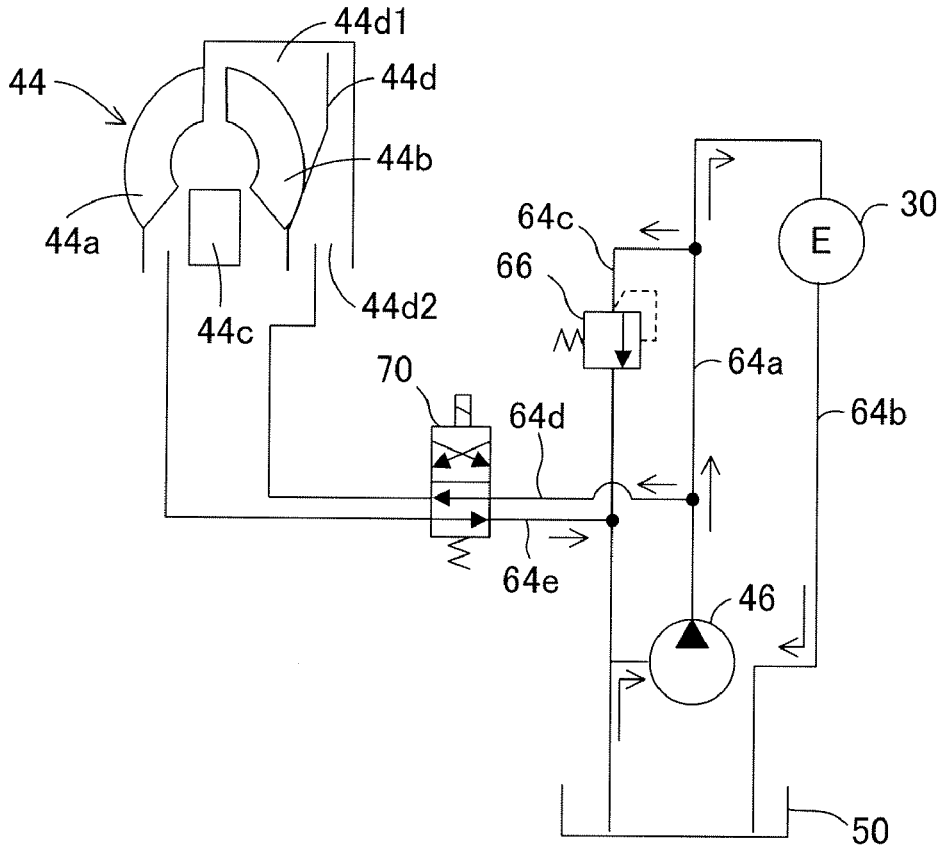
FIG. 5 is a hydraulic circuit diagram schematically showing the torque converter, a hydraulic pump and other components shown in FIG. 2.

FIG. 5 is a hydraulic circuit diagram schematically showing the torque converter 44, hydraulic pump 46, etc.

The hydraulic pump 46 driven by the engine 30 pumps up the operating oil in the reservoir 50 and forwards it to a first oil passage 64*a*. The pressurized operating oil forwarded to the first oil passage 64*a* is supplied to the lubricated portion of the engine 30, the power tilt-trim unit 26 and the like, and then returns to the reservoir 50 through a second oil passage 64*b*.

The first oil passage 64*a* is provided with a third oil passage 64*c* connecting the first oil passage 64*a* with an intake hole of the hydraulic pump 46. The third oil passage 64*c* is interposed with a relief valve 66 that opens when the pressure of the operating oil to be supplied to the engine 30 is at or above a defined value and closes when it is below the defined value.

A fourth oil passage 64*d* for circulating the operating oil to be supplied to the torque converter 44 is connected to the first oil passage 64*a* at a point between a discharge hole of the hydraulic pump 46 and a branch point of the first and third oil passages 64*a*, 64*c*. A fifth oil passage 64*e* for circulating the operating oil returning from the torque converter 44 to the hydraulic pump 46 is connected to the third oil passage 64*c* at a location downstream of the relief valve 66. The fourth and fifth oil passages 64*d*, 64*e* are installed with a lockup control valve 70 for controlling the operation of the lockup clutch 44*d*.

The lockup control valve 70 is a solenoid valve. The output of the valve 70 is connected to a piston chamber 44*d*1 of the lockup clutch 44*d* of the torque converter 44, and also connected to a chamber (rear chamber) 44*d*2 disposed in the rear of the piston chamber 44*d*1. The lockup control valve 70 switches the oil passage upon being magnetized/demagnetized, thereby controlling the ON/OFF state (engagement/release) of the lockup clutch 44*d*.

Specifically, when the lockup control valve 70 is magnetized, the operating oil is supplied to the piston chamber 44*d*1 and discharged from the rear chamber 44*d*2 so as to make the lockup clutch 44*d* ON (engaged), and when the valve 70 is demagnetized (the status in FIG. 5; initial condition), the operating oil is supplied to the rear chamber 44*d*2 and discharged from the piston chamber 44*d*1 so as to make the lockup clutch 44*d* OFF (released). Since the details of the aforementioned torque converter 44 is disclosed in '498, further explanation is omitted here.

The explanation of FIG. 2 will be resumed. The shift mechanism 54 comprises a forward bevel gear 54*a* and reverse bevel gear 54*b* which are connected to the drive shaft 42 to be rotated, a clutch 54*c* which can engage the propeller shaft 56 with either one of the forward bevel gear 54*a* and reverse bevel gear 54*b*, and other components.

The interior of the engine cover 32 is disposed with an electric shift motor (actuator) 72 that drives the shift mechanism 54. The output shaft of the shift motor 72 can be connected via a speed reduction gear mechanism (not shown) with the upper end of a shift rod 54*d* of the shift mechanism 54. When the shift motor 72 is operated, its output appropriately displaces the shift rod 54*d* and a shift slider 54*e* to move the clutch 54*c* to change the shift position among a forward position, reverse position and neutral position.

When the shift position is forward or reverse, the rotational output of the drive shaft 42 is transmitted via the shift mechanism 54 to the propeller shaft 56 to rotate the propeller 60 in one of the directions making the boat 12 move forward or rearward. The outboard motor 10 is equipped with a power source (not shown) such as a battery or the like attached to the engine 30 to supply operating power to the motors 24, 40, 72, etc.

As shown in FIG. 3, a throttle opening sensor 74 is installed near the throttle valve 38 and produces an output or signal indicative of opening of the throttle valve 38, i.e., throttle opening TH. A shift position sensor 80 installed near the shift rod 54*d* produces an output or signal corresponding to a shift position (neutral, forward or reverse) and a neutral switch 82 also installed near the shift rod 54*d* produces an ON signal when the shift position is neutral and an OFF signal when it is forward or reverse.

A crank angle sensor 84 is installed near the crankshaft 52 of the engine 30 and produces a pulse signal at every predetermined crank angle. A drive shaft rotation speed sensor 86 is installed near the drive shaft 42 and produces an output or signal indicative of rotation speed of the drive shaft 42.

A trim angle sensor (rotation angle sensor) 88 is installed near the swivel case 18 and produces an output or signal corresponding to a trim angle θtrm of the outboard motor 10 (precisely, a rotation angle of the outboard motor 10 about the pitch axis relative to the boat 12).

The outputs of the foregoing sensors and switch are sent to an electronic control unit (ECU) 90 disposed in the outboard motor 10. The ECU 90 which has a microcomputer including a CPU, ROM, RAM and other devices is installed in the engine cover 32 of the outboard motor 10.

As shown in FIG. 1, a steering wheel 94 is installed near a cockpit (the operator's seat) 92 of the boat 12 to be manipulated or rotated by the operator. A steering angle sensor 96 installed near a shaft (not shown) of the steering wheel 94 produces an output or signal corresponding to the steering angle applied or inputted by the operator through the steering wheel 94.

A remote control box 100 provided near the cockpit 92 is equipped with a shift/throttle lever 102 installed to be manipulated by the operator. Upon the manipulation, the lever 102 can be swung in the front-back direction from the initial position and is used by the operator to input a shift position change command and engine speed regulation command. A lever position sensor 104 is installed in the remote control box 100 and produces an output or signal corresponding to a position of the lever 102.

A power tilt-trim switch 106 is also provided near the cockpit 92 to be manually operated by the operator to input tilt/trim angle regulation commands, and produces an output or signal indicative of the command inputted by the operator to tilt up/down or trim up/down the outboard motor 10. The outputs of the steering angle sensor 96, lever position sensor 104 and power tilt-trim switch 106 are also sent to the ECU 90.

Based on the inputted outputs, the ECU 90 controls the operations of the motors and the ON/OFF state of the lockup clutch 44*d* of the torque converter 44, while controlling the operation of the power tilt-trim unit 26 to regulate the trim angle.

Figure 6:
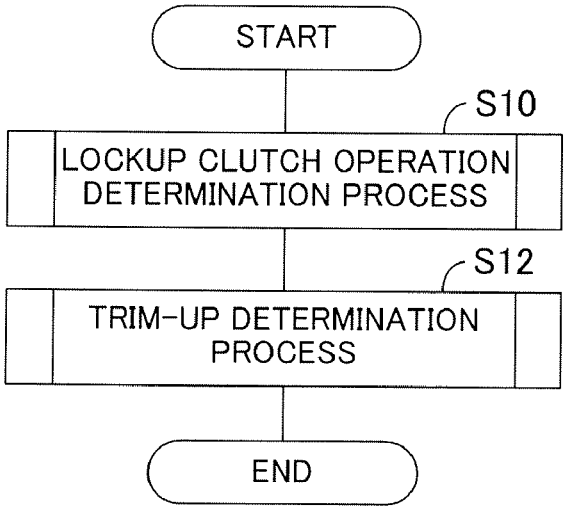
FIG. 6 is a flowchart showing the control of an electronic control unit shown in FIG. 1.

FIG. 6 is a flowchart showing the control of the ECU 90. The illustrated program is executed by the ECU 90 at predetermined interval, e.g., 100 milliseconds.

The program begins in S10, in which a determination as to whether the lockup clutch 44*d* should be operated is made (i.e., the control of ON/OFF state of the lockup clutch 44*d* is conducted).

Figure 7:
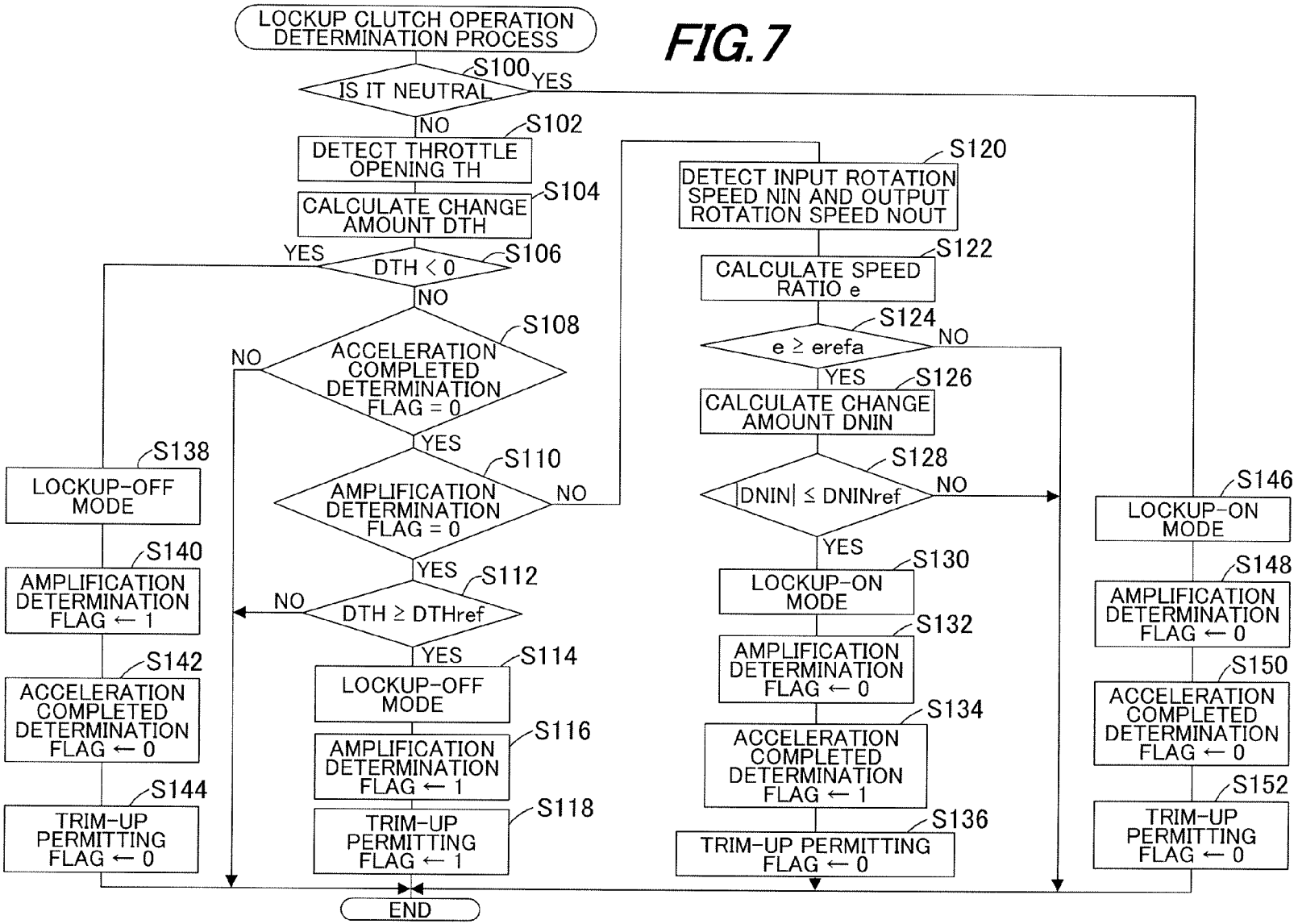
FIG. 7 is a subroutine flowchart of a lockup clutch operation determination process shown in FIG. 6.

FIG. 7 is a subroutine flowchart of the determination process, i.e., a lockup clutch operation determination process of FIG. 6.

In S100, it is determined whether the shift position is neutral. This determination is made by checking as to whether the neutral switch 82 outputs the ON signal. When the result is negative, i.e., it is determined to be in gear, the program proceeds to S102, in which the throttle opening TH is detected or calculated from the output of the throttle opening sensor 74 and to S104, in which a change amount (variation) DTH of the detected throttle opening TH per a unit time (e.g., 500 milliseconds) is calculated.

The program proceeds to S106, in which it is determined whether the throttle valve 38 is operated in the closing direction, i.e., the boat 12 is in a condition to be decelerated (hereinafter called "decelerating condition"). This determination is made by checking as to whether the change amount DTH of the throttle opening TH is less than 0 degree. Specifically, when the change amount DTH is a negative value, the throttle valve 38 is determined to be operated in the closing direction (the boat 12 is in the decelerating condition) and when the change amount DTH is 0 or a positive value, the throttle valve 38 is determined to be stopped or operated in the opening direction (the boat 12 is operated to cruise at a constant speed or accelerate).

When the result in S106 is negative, the program proceeds to S108, in which it is determined whether a bit of an acceleration completed determination flag of the torque converter 44 (torque converter acceleration completed determination flag; explained later) is 0. Since the initial value of this flag is 0, the result in S108 in the first program loop is generally affirmative and the program proceeds to S110, in which it is determined whether a bit of an amplification determination flag of the torque converter 44 (torque converter amplification determination flag) is 0.

As explained below, a bit of the amplification determination flag is set to 1 when a condition where the output torque of the engine 30 is amplified through the torque converter 44 and transmitted to the drive shaft 42 (i.e., where the operation of the outboard motor 10 is in a range (torque amplification range) that the torque is to be amplified by the torque converter 44 to accelerate the boat 12) is established, and reset to 0 when the output torque of the engine 30 is not amplified (i.e., the operation of the outboard motor 10 is out of the torque amplification range).

Since the initial value of the amplification determination flag is also 0, the result in S110 in the first program loop is generally affirmative and the program proceeds to S112, in which it is determined whether the throttle valve 38 is operated in the opening direction, i.e., the boat 12 is in a condition to be accelerated (hereinafter called "accelerating condition"). Specifically, the calculated change amount DTH of the throttle opening TH is compared with a throttle predetermined value (threshold value) DTHref and, when the change amount DTH is equal to or greater than the predetermined value DTHref, the throttle valve 38 is determined to be operated in the opening direction (the boat 12 is in the accelerating condition). The throttle predetermined value DTHref is set to a value (e.g., 0.5 degree) enabling to determine whether the boat 12 is in the accelerating condition.

When the result in S112 is negative, i.e., when the boat 12 is determined to be neither decelerated nor accelerated but is operated to cruise at a constant speed, the remaining steps are skipped and when the result is affirmative, the program proceeds to S114, in which the torque converter 44 is controlled with a lockup-OFF mode. The operation in the lockup-OFF mode is to demagnetize the lockup control valve 70 and make the lockup clutch 44*d* of the torque converter 44 OFF. As a result, the output torque of the engine 30 is amplified through the torque converter 44 and transmitted to the drive shaft 42, thereby improving acceleration performance.

Next, in S116, a bit of the torque converter amplification determination flag is set to 1 and in S118, a bit of a trim-up permitting flag (initial value 0; explained later) is set to 1. Upon setting of a bit of the amplification determination flag to 1 in S116, the result in S110 in the next and subsequent loops becomes negative and the program proceeds to S120.

Thus, when a bit of the amplification determination flag is set to 1, specifically, it is in the condition where the output torque of the engine 30 is amplified through the torque converter 44 to accelerate the boat 12, the result in S110 is negative as mentioned above.

In S120, an input rotation speed NIN and output rotation speed NOUT of the torque converter 44 are detected or calculated. Since the input side of the torque converter 44 is connected to the crankshaft 52 of the engine 30, the input rotation speed NIN is identical with the engine speed and therefore can be detected by counting the output pulses of the crank angle sensor 84. The output rotation speed NOUT is detected from the output of the drive shaft rotation speed sensor 86.

The program proceeds to S122, in which a speed ratio e of the torque converter 44 is calculated based on the input rotation speed NIN and output rotation speed NOUT. The speed ratio e is obtained by dividing the output rotation speed NOUT by the input rotation speed NIN as shown in the following equation.

$$\text{Speed ratio } e = (\text{Output rotation speed NOUT})/(\text{Input rotation speed NIN})$$

The program proceeds to S124, in which it is determined whether the torque amplification range of the torque converter 44 has ended, i.e., whether the torque amplification range (acceleration range) has been saturated and the acceleration has been completed. Specifically, the calculated speed ratio e is compared to a reference value erefa and when the speed ratio e is equal to or greater than the reference value erefa, i.e., when it reaches the reference value erefa, it is determined that the torque amplification range has ended. The reference value erefa is set to a value (e.g., 0.7) enabling to determine whether the torque amplification range has ended.

When the result in S124 is affirmative, the program proceeds to S126, in which a change amount DNIN of the input rotation speed NIN (i.e., a change amount (variation) of the engine speed) is calculated. The change amount DNIN is obtained by subtracting the input rotation speed NIN detected in the present program loop from that detected in the previous program loop.

The program proceeds to S128, in which it is determined whether the speed of the boat 12 remains stable at the maximum speed or thereabout after the acceleration is completed. This determination is made by comparing an absolute value of the calculated change amount DNIN with a prescribed value (threshold value) DNINref. When the absolute value is equal to or less than the prescribed value DNINref, it is determined that the boat speed is stable at about the maximum value. The prescribed value DNINref is set to a value (e.g., 500 rpm) enabling to determine whether the speed of the boat 12 remains stable at about the maximum value after the acceleration is completed, in other words, the change amount DNIN is relatively small.

When the result in S128 is affirmative, the program proceeds to S130, in which the torque converter 44 is controlled with a lockup-ON mode. The operation of the lockup-ON mode is to magnetize the lockup control valve 70 and make the lockup clutch 44*d* ON. Since this establishes the direct connection between the crankshaft 52 of the engine 30 and the drive shaft 42, slippage of the torque converter 44 can be prevented so that the speed of the boat 12 reaches the maximum speed (in a range of the engine performance), thereby improving speed performance.

After the step of S130, in S132, a bit of the torque converter amplification determination flag is reset to 0, in S134, a bit of the torque converter acceleration completed determination flag is set to 1, and in S136, a flag of the trim-up permitting flag is reset to 0.

As is clear from above, a bit of the acceleration completed determination flag is set to 1 when the acceleration through torque amplification by the torque converter 44 is completed and the lockup clutch 44*d* is made ON, and in the other cases, reset to 0, as described later. Setting a bit of the trim-up permitting flag to 1 means that the throttle valve 38 is operated in the opening direction to accelerate the boat 12 and the trim-up operation to be conducted based on the speed ratio e (explained later) is permitted, and resetting it to 0 means that the boat 12 is not in a condition to be accelerated and the trim-up operation is not needed.

When the result in S124 or S128 is negative, since it means that the torque amplification range of the torque converter 44 does not end (is not saturated), or that the boat speed is not stable at about the maximum speed, the steps of S130 to S136, etc., are skipped and the program is terminated. When a bit of the acceleration completed determination flag is set to 1 in S134, the result in S108 in the next and subsequent loops is negative and the steps of S110 to S136 are skipped.

When the result in S106 is affirmative, i.e., when the throttle valve 38 is operated in the closing direction (the boat 12 is in the decelerating condition), the program proceeds to S138, in which the torque converter 44 is controlled with the lockup-OFF mode, to 5140, in which a bit of the amplification determination flag is set to 1, to S142, in which a bit of the acceleration completed determination flag is reset to 0, and then to S144, in which a bit of the trim-up permitting flag is reset to 0.

When the result in S100 is affirmative, i.e., when the shift position is neutral, the program proceeds to S146, in which the torque converter 44 is controlled with the lockup-ON mode, to S148, in which a bit of the amplification determination flag is reset to 0, and to S150 and 152, in which bits of the acceleration completed determination flag and trim-up permitting flag are reset to 0.

Returning to the explanation on the FIG. 6 flowchart, the program proceeds to S12, in which a determination as to whether the trim-up operation of the outboard motor 10 should be conducted is made.

Figure 8:
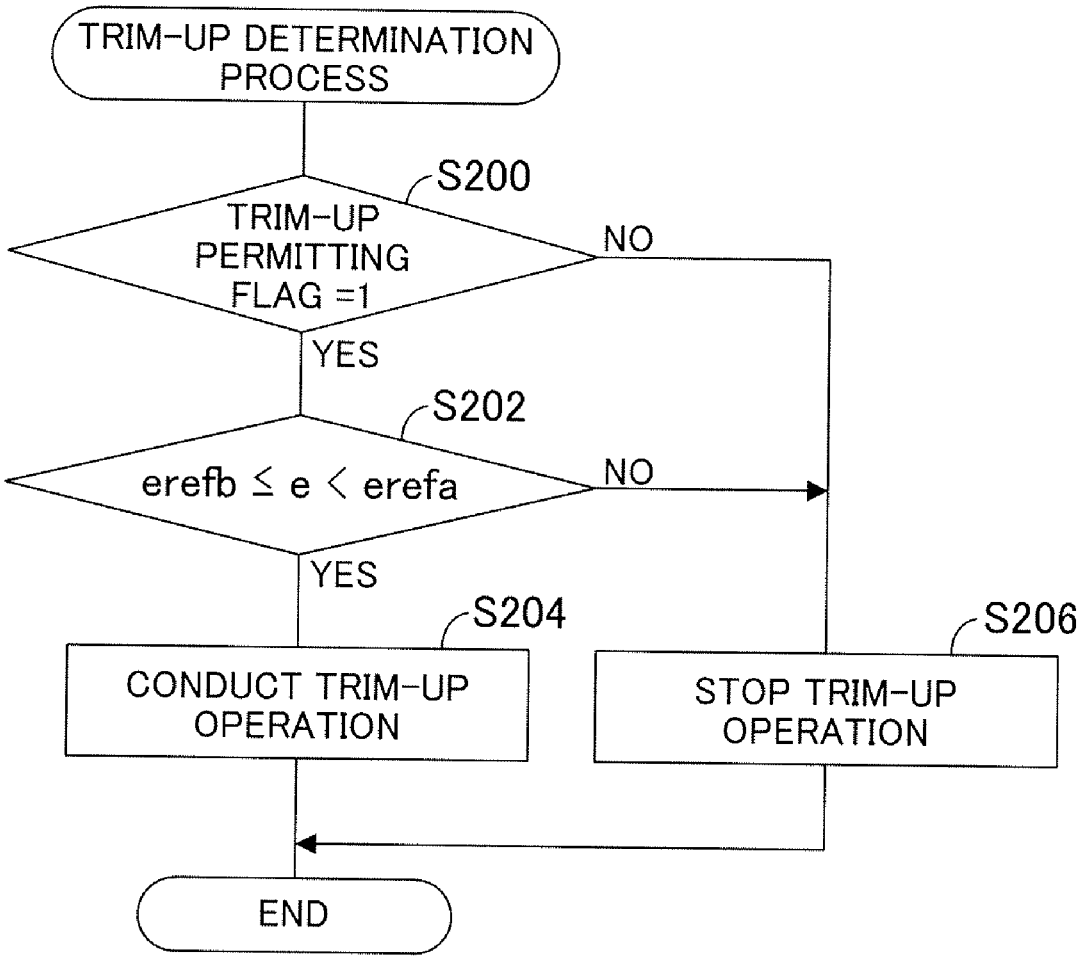
FIG. 8 is a subroutine flowchart of a trim-up determination process shown in FIG. 6.

FIG. 8 is a subroutine flowchart of the determination process, i.e., a trim-up determination process. As shown in FIG. 8, in S200, it is determined whether a bit of the trim-up permitting flag is 1. When the result is affirmative, i.e., when the throttle valve 38 is operated in the opening direction to accelerate the boat 12, the program proceeds to S202, in which it is determined whether it is immediately before the end of the torque amplification range of the torque converter 44, i.e., before the torque amplification range (acceleration range) is saturated and the acceleration is completed.

Specifically, it is determined whether the speed ratio e of the torque converter 44 is equal to or greater than a predetermined value erefb and less than the reference value erefa, and when the result is affirmative, it is determined to be immediately before the end of the torque amplification range. The predetermined value erefb is set to a value (e.g., 0.6) smaller than the reference value erefa and enabling to determine whether it is immediately before the end of the torque amplification range. In other words, the reference value erefa is set greater than the predetermined value erefb.

When the result in S202 is affirmative, the program proceeds to S204, in which the power tilt-trim unit 26 is operated to start or conduct the trim-up operation of the outboard motor 10.

In a program loop after starting the trim-up operation in S204, when the speed ratio e reaches the reference value erefa, the result in S202 is negative and the program proceeds to S206, in which the trim-up operation is stopped.

Also When the speed ratio e of the torque converter 44 is less than the predetermined value erefb, the result in S202 is negative and in this case, since it means that the condition is not for starting the trim-up operation, the program proceeds to S206, in which the trim-up operation is not conducted. When the result in S200 is negative, since it means that the trim-up operation is not necessary, the program similarly proceeds to S206, whereafter the program is terminated without conducting the trim-up operation.

Owing to this configuration, before the lockup clutch 44*d* is made ON, the power tilt-trim unit 26 is operated to start the trim-up operation so that the thrust of the boat 12 can be increased to increase the boat speed. In addition, since the trim-up operation is stopped when the speed ratio e reaches the reference value erefa, this stopping operation is conducted in synchronization with the aforementioned processing of S130 of making the lockup clutch 44*d* ON.

In S202, it is also determined whether the power tilt-trim switch 106 produces a signal indicative of a trim angle regulation command or the like upon manipulation by the operator. When the signal is produced and inputted, regardless of the speed ratio e, the power tilt-trim unit 26 is operated in accordance with the inputted signal. Thus the operator can operate the power tilt-trim unit 26 by manipulating the power tilt-trim switch 106, thereby regulating the trim angle θtrm at any time.

Figure 9:
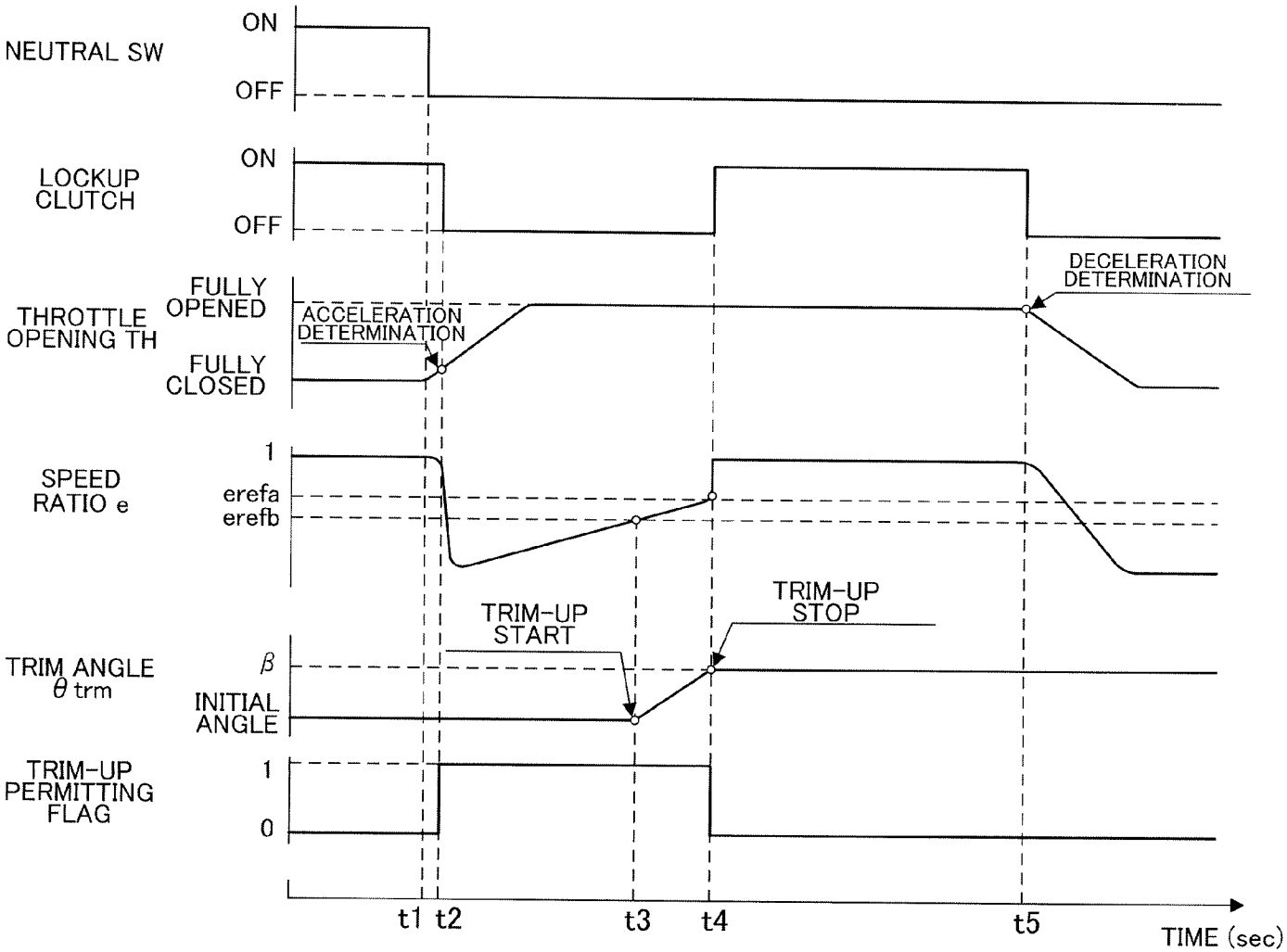
FIG. 9 is a time chart for explaining the processing of the FIG. 6 flowchart.
Figure 10A:
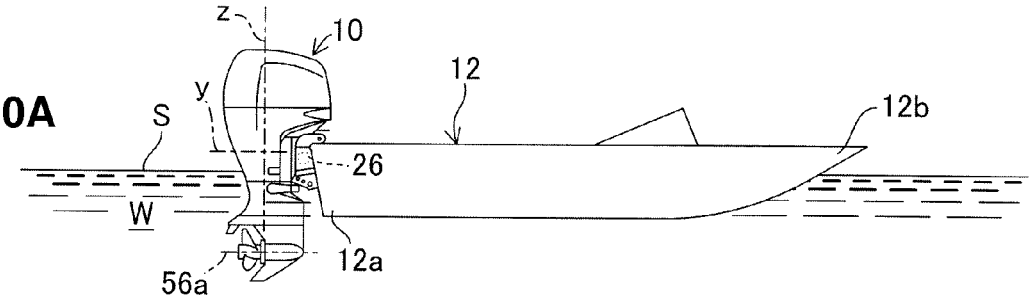
FIGS. 10A to 10C are explanatory views for explaining the operation of the FIG. 6 flowchart.
Figure 10B:
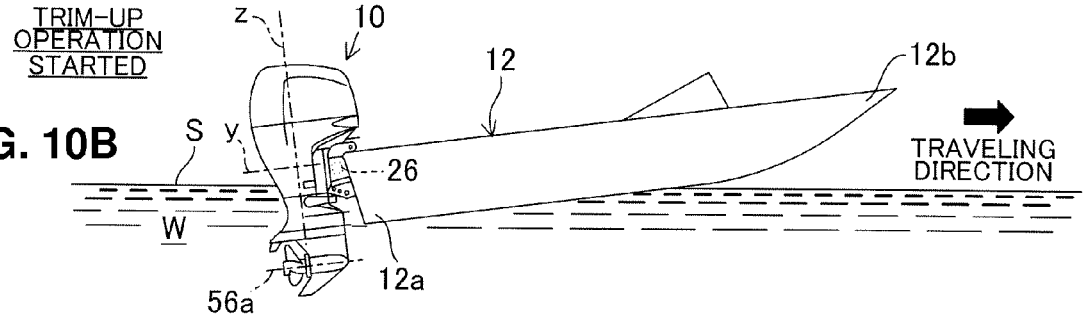
Figure 10C:
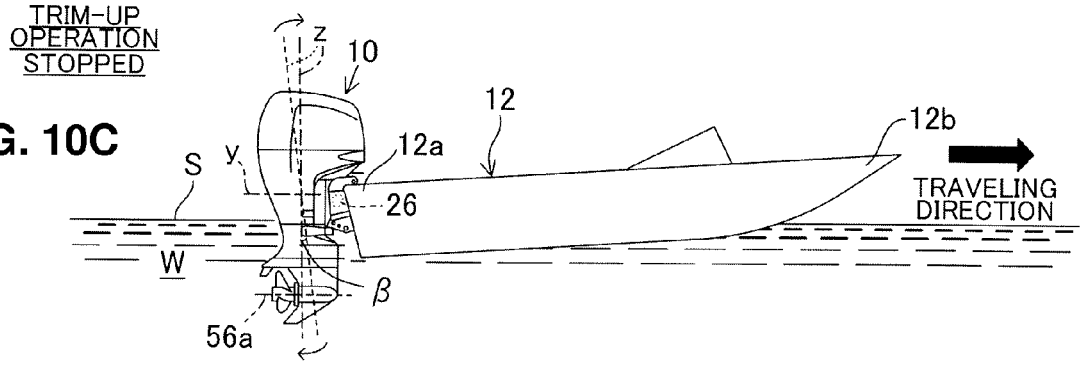

FIG. 9 is a time chart for explaining the foregoing processing and FIGS. 10A to 10C are explanatory views thereof. In FIG. 10, a symbol y indicates the front-back direction of the outboard motor 10, a symbol z the vertical direction thereof, a symbol W seawater or freshwater, and a symbol S the water surface. The front-back direction y and vertical direction z represent those with respect to the outboard motor 10 and they may differ from the gravitational direction and horizontal direction depending on the tilt angle or trim angle of the outboard motor 10.

The explanation on the FIG. 9 time chart will be made with reference to FIGS. 10A to 10C. At the time t1, the shift position is changed from neutral to any in-gear position upon the manipulation of the shift/throttle lever 102 by the operator (S100). When the throttle valve 38 is gradually opened and the boat 12 is determined to be in the accelerating condition at the time t2, the lockup clutch 44*d* is made OFF (S112, S114). At this time, a bit of the trim-up permitting flag is set to 1 (S118).

As shown in FIG. 10A, at the time t1, the boat 12 and outboard motor 10 are both in the horizontal position. When the boat speed increases through the acceleration at and after the time t2, as shown in FIG. 10B, the bow 12*b* of the boat 12 is lifted up and the stern 12*a* thereof is sunk down (the boat speed lies the so-called "hump" region). As can be seen from the drawing, the axis line 56*a* of the propeller shaft 56 is not parallel with the traveling direction of the boat 12.

When the acceleration is continued and the speed ratio e of the torque converter 44 becomes equal to or greater than the predetermined value erefb (time t3), the trim-up operation of the outboard motor 10 is started (S202, S204). When the speed ratio e reaches the reference value erefa at the time t4, the trim-up operation is stopped and the lockup clutch 44*d* is made ON (S124, S130, S202, S206). At this time, a bit of the trim-up permitting flag is reset to 0 (S136).

FIG. 10C is a view showing a condition where the trim angle θtrm is regulated to an angle β by stopping the trim-up operation. As clearly shown, since the outboard motor 10 is trimmed up to regulate the trim angle θtrm to the angle β, the axis line 56*a* of the propeller shaft 56 (i.e., the direction of thrust of the outboard motor 10) can be positioned substantially parallel with the traveling direction of the boat 12, resulting in the increase of the thrust of the boat 12 and the decrease of resistance against the boat 12 from the water surface S, thereby increasing the boat speed.

After that, when, at the time t5, it is determined that the throttle valve 38 is operated in the closing direction (the boat 12 is in the decelerating condition) through the manipulation of the shift/throttle lever 102 by the operator, the lockup clutch 44*d* is made OFF (S106, S138).

As stated above, the first embodiment is configured to calculate the speed ratio e of the torque converter 44 based on the input rotation speed NIN and output rotation speed NOUT and operate the power tilt-trim unit 26 to start the trim-up operation of the outboard motor 10 when the speed ratio e is equal to or greater than the predetermined value erefb. Since the predetermined value erefb can be set to a value of immediately before the lockup clutch 44*d* is made ON after the acceleration is completed, it becomes possible to trim up the outboard motor 10 to increase the boat speed before the lockup clutch 44*d* is made ON. As a result, even when the lockup clutch 44*d* is made ON after the acceleration is completed and the torque transmitted to the drive shaft 42 is decreased, since the boat speed is increased through the trim-up operation, the deceleration feel given to the operator can be avoided or mitigated.

Further, it is configured to stop the trim-up operation when the speed ratio e reaches the reference value erefa set greater than the predetermined value erefb, and to control the lockup clutch 44*d* to ON. With this, it becomes possible to accurately detect the time that the acceleration is completed and, since the lockup clutch 44*d* is made ON upon the completion of acceleration, speed performance can be enhanced. Further, since the trim-up operation is stopped in synchronization with making the lockup clutch 44*d* ON, it can be stopped at the appropriate timing, precisely at the time when the speed ratio e is sufficiently increased so that the further trim-up operation is not necessary. Therefore, the trim angle θtrm can be set appropriately with respect to the boat 12 and the pitching of the boat 12 can be prevented.

Since it is configured to start the trim-up operation when the throttle valve 38 is determined to be operated in the opening direction and when the speed ratio e is equal to or greater than the predetermined value erefb, the trim-up operation can be started upon the reliable determination of acceleration, thereby effectively mitigating the decelerating feel generated after the completion of acceleration.

Since it is configured to operate the power tilt-trim unit 26 when the power tilt-trim switch 106 is manipulated, the operator can operate the power tilt-trim unit 26 by manipulating the switch 106, thereby regulating the trim angle θtrm at any time.

An outboard motor control apparatus according to a second embodiment of the invention will be explained.

Figure 11:
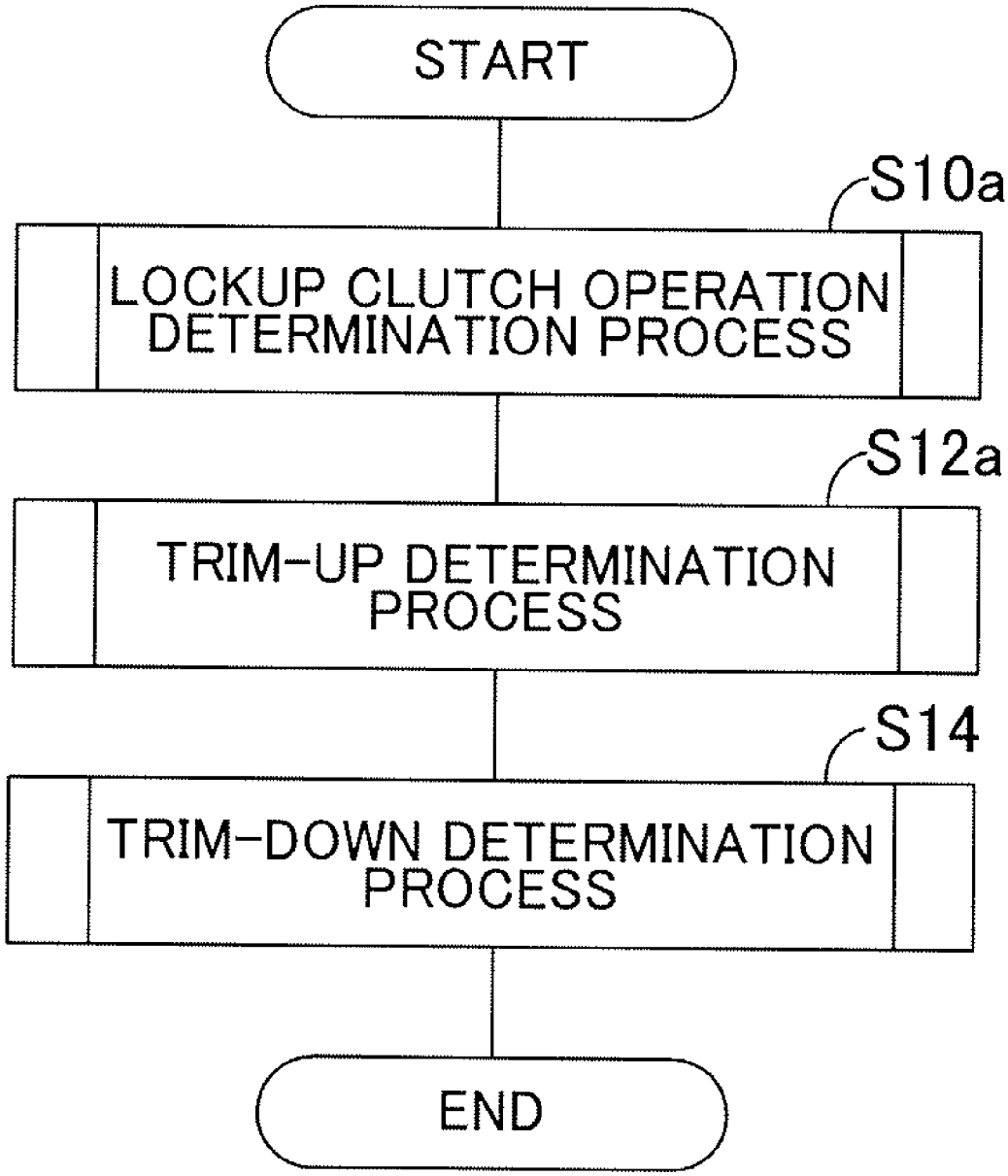
FIG. 11 is a flowchart similar to FIG. 6, but showing the control of an electronic control unit of an outboard motor control apparatus according to a second embodiment of the invention.

FIG. 11 is a flowchart similar to FIG. 6, but showing the control of the ECU 90. The illustrated program is executed by the ECU 90 at predetermined interval, e.g., 100 milliseconds.

The explanation will be made with focus on points of difference from the first embodiment. In the second embodiment, in S 10*a*, a determination as to whether the lockup clutch 44*d* should be operated is made.

Figure 12:
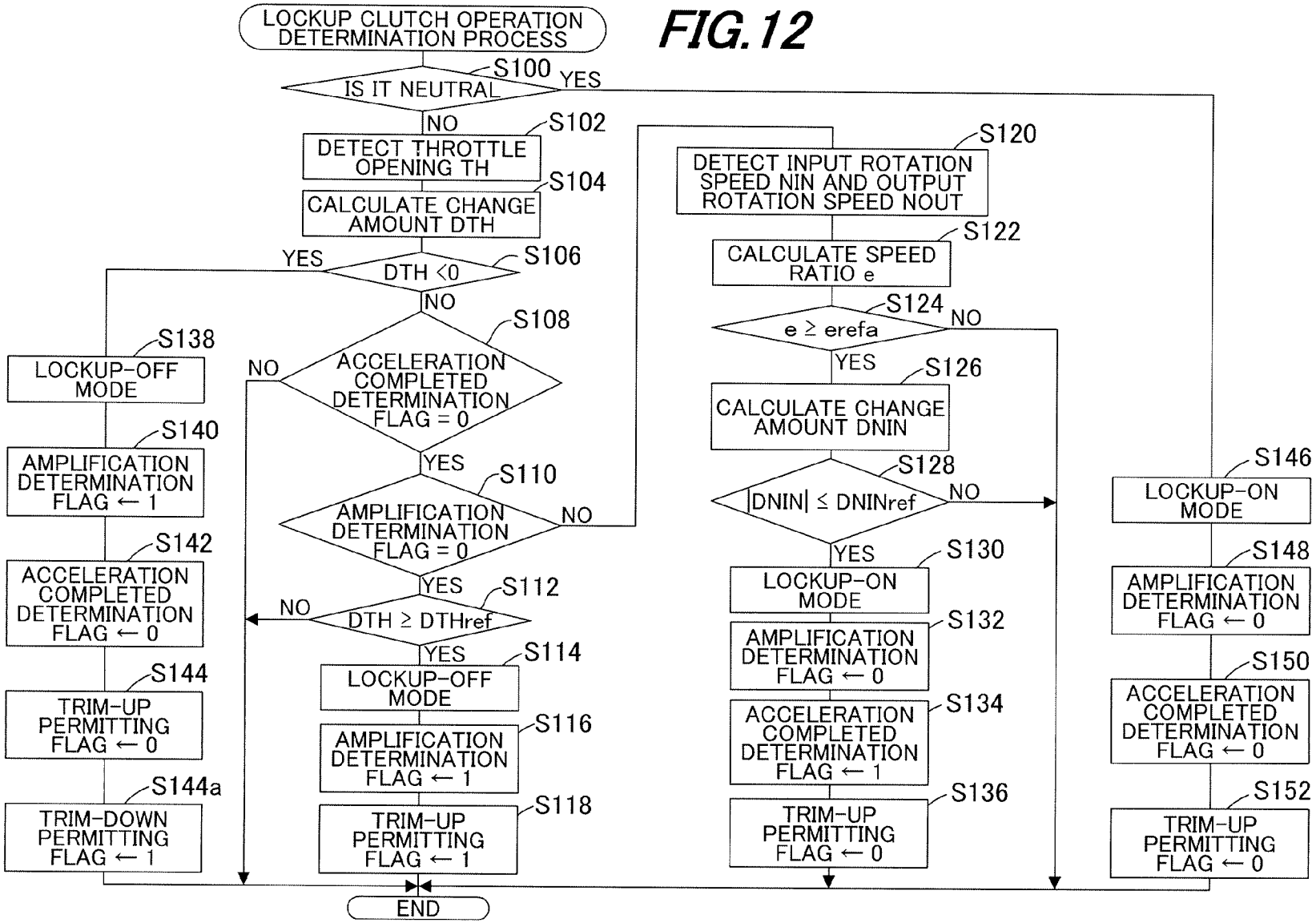
FIG. 12 is a subroutine flowchart similar to FIG. 7, but showing a lockup clutch operation determination process shown in FIG. 11.

FIG. 12 is a subroutine flowchart similar to FIG. 7, but showing the determination process, i.e., a lockup clutch operation determination process of FIG. 11. In FIG. 12, the same steps as those in the FIG. 7 flowchart are applied with the same step numbers and the explanation thereof will be omitted.

After the processing of S100 to S144, the program proceeds to S144*a*, a bit of a trim-down permitting flag is set to 1. A bit of this flag is initially 0 and set to 1 when the throttle valve 38 is determined to be operated in the closing direction.

Returning to the explanation on the FIG. 11 flowchart, the program proceeds to S12*a*, in which a determination as to whether the trim-up operation of the outboard motor 10 should be conducted is made.

Figure 13:
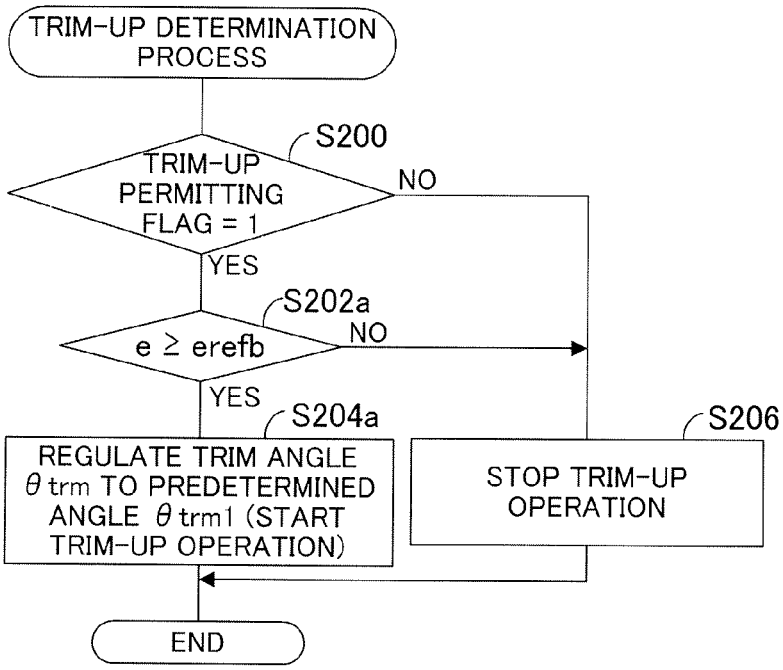
FIG. 13 is a subroutine flowchart similar to FIG. 8, but showing a trim-up determination process shown in FIG. 11.

FIG. 13 is a subroutine flowchart similar to FIG. 8, but showing the determination process, i.e., a trim-up determination process of FIG. 11. In FIG. 13, the same steps as those in the FIG. 8 flowchart are applied with the same step numbers and the explanation thereof will be omitted.

In S200, it is determined whether a bit of the trim-up permitting flag is 1 and when the result is affirmative, in S202*a*, it is determined whether it is immediately before the end of the torque amplification range of the torque converter 44. Specifically, when the speed ratio e of the torque converter 44 is equal to or greater than the predetermined value erefb, it is determined to be immediately before the end of the torque amplification range.

When the result in S202*a* is affirmative, the program proceeds to S204*a*, in which the power tilt-trim unit 26 is operated to regulate the trim angle θtrm detected from the output of the trim angle sensor 88 to a predetermined angle θtrm 1, thereby trimming up the outboard motor 10. The predetermined angle θtrm1 is set to a value enabling to increase the thrust of the boat 12, which will be explained in detail later.

When the result in S200 or S202*a* is negative, the program proceeds to S206, in which the trim-up operation is stopped if being conducted, and the program is terminated.

Owing to this configuration, before the lockup clutch 44*d* is made ON, the trim angle θtrm can be regulated to the predetermined angle θtrm1 by operating the power tilt-trim unit 26, thereby increasing the thrust of the boat 12 to increase the boat speed.

In S202*a*, similarly to S202 of FIG. 8 in the first embodiment, it is also determined whether the power tilt-trim switch 106 produces a signal indicative of a trim angle regulation command or the like and when the signal is produced and inputted, the power tilt-trim unit 26 is operated in accordance with the signal.

Returning to the explanation on the FIG. 11 flowchart, the program proceeds to S14, in which a determination as to whether a trim-down operation of the outboard motor 10 should be conducted is made.

Figure 14:
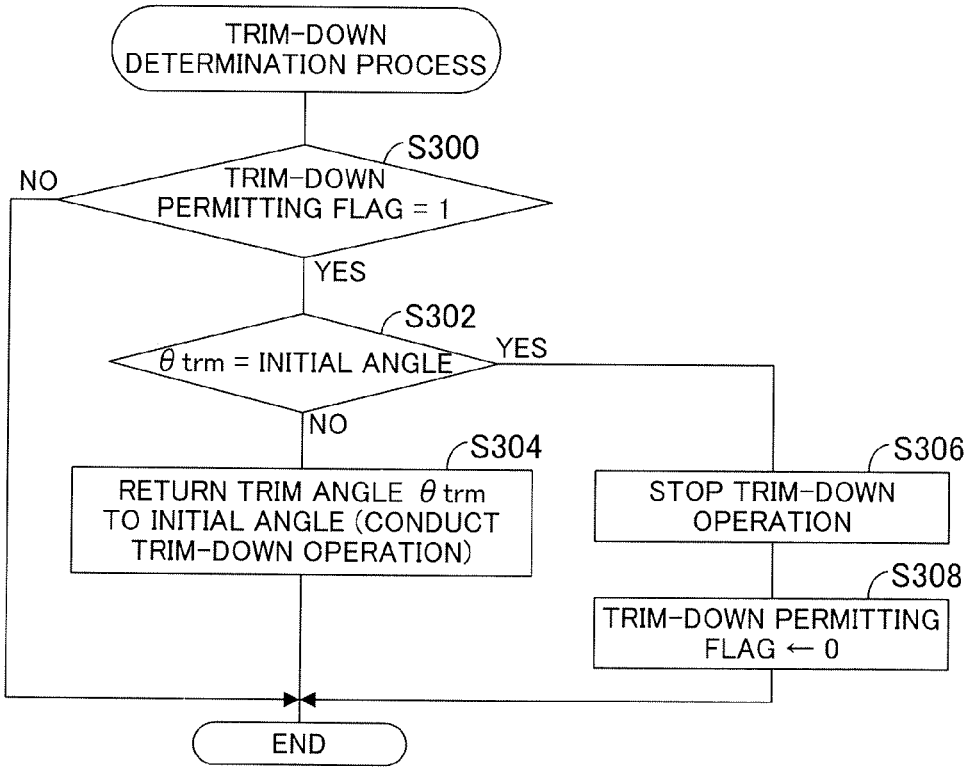
FIG. 14 is a subroutine flowchart of a trim-down determination process shown in FIG. 11.

FIG. 14 is a subroutine flowchart of the determination process, i.e., a trim-down determination process of FIG. 11. In S300, it is determined whether a bit of the trim-down permitting flag is 1. When the result is negative, the remaining steps are skipped and when the result is affirmative, i.e., when the throttle valve 38 is operated in the closing direction and the boat 12 is in the decelerating condition, the program proceeds to S302, in which it is determined whether the trim angle θtrm is at the initial angle (e.g., 0 degree).

When the result in S302 is negative, i.e., when the trim angle θtrm is regulated to the predetermined angle θtrm1 by the trim-up operation in S204*a*, the program proceeds to S304, in which the power tilt-trim unit 26 is operated to return the trim angle θtrm to the initial angle to trim down the outboard motor 10.

When the result in S302 is affirmative because, for example, the trim angle θtrm was returned from the predetermined angle θtrm1 to the initial angle by the trim-down operation in S304 in the previous program loop, the program proceeds to S306, in which the trim-down operation is stopped and to S308, in which a bit of the trim-down permitting flag is reset to 0, whereafter the program is terminated.

Figure 15:
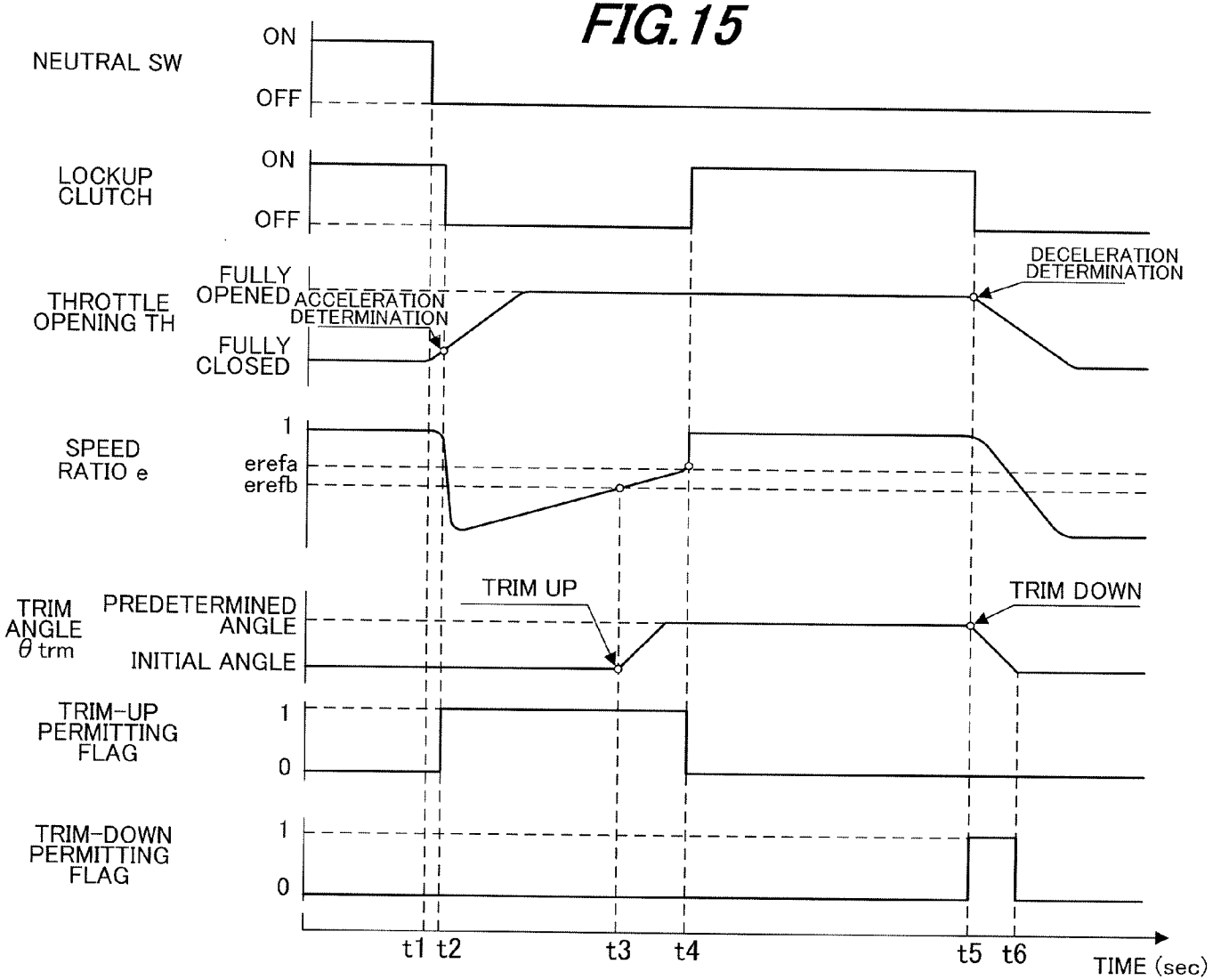
FIG. 15 is a time chart similar to FIG. 9, but explaining the processing of the FIG. 11 flowchart.

FIG. 15 is a time chart similar to FIG. 9, but explaining the foregoing processing and FIGS. 16A to 16D are explanatory views thereof, similar to FIGS. 10A to 10C. The explanation on the FIG. 15 time chart will be made with reference to FIGS. 16A to 16D. The explanation with respect to the time t1 and time t2 is the same as the first embodiment, so it is omitted here.

Figure 16A:
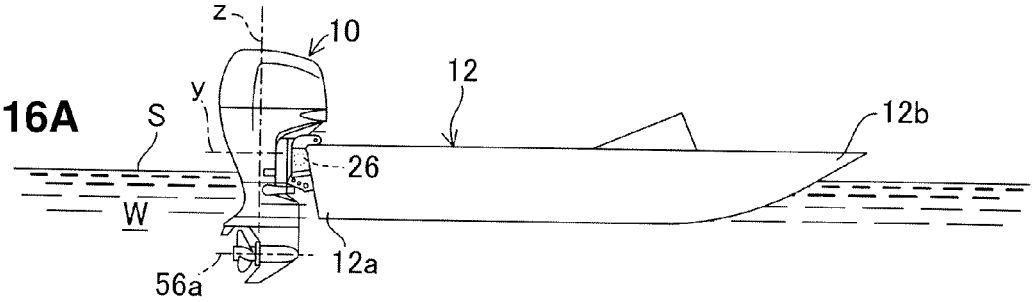
FIGS. 16A to 16D are explanatory views similar to FIGS. 10A to 10C, but explaining the processing of the FIG. 11 flowchart.
Figure 16B:
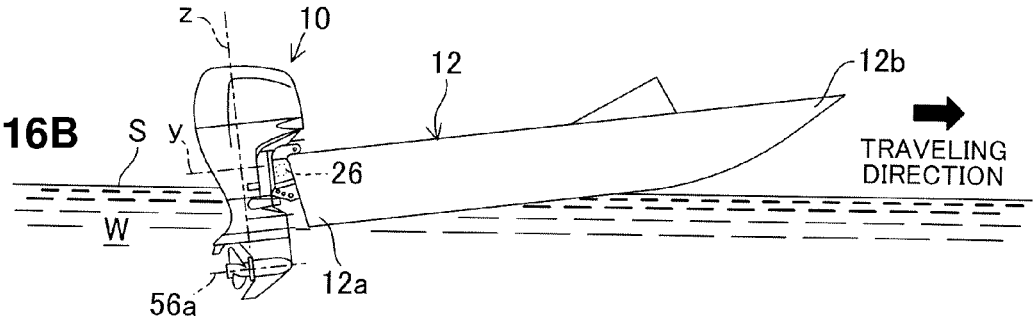
Figure 16C:
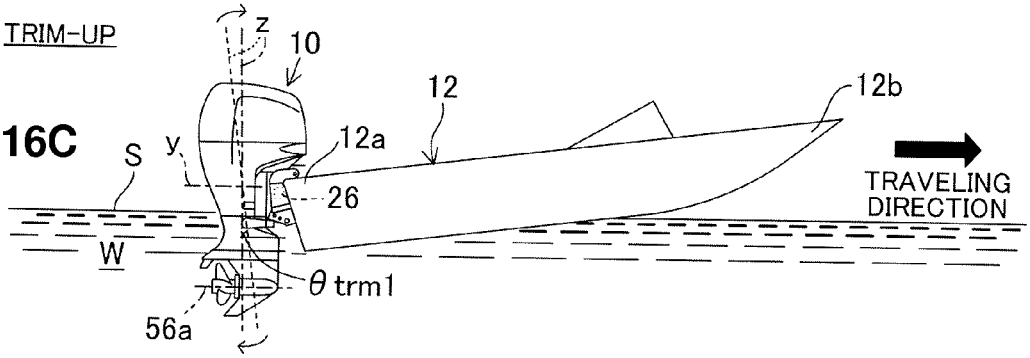

After the time t2, when the acceleration is continued and the speed ratio e becomes equal to or greater than the predetermined value erefb (at the time t3), the trim-up operation is started to regulate the trim angle θtrm to the predetermined angle θtrm1 (S202*a*, S204*a*). The condition where the trim angle θtrm is regulated to the predetermined angle θtrm1 is shown in FIG. 16C.

As clearly shown, since the trim angle θtrm is regulated to the predetermined angle θtrm1, the axis line 56*a* of the propeller shaft 56 can be positioned substantially parallel with the traveling direction of the boat 12, resulting in the increase of the thrust of the boat 12 and the decrease of resistance against the boat 12 from the water surface S, thereby increasing the boat speed. Therefore, the predetermined angle θtrm1 is set to a value (e.g., 5 degrees) enabling the axis line 56*a* to be positioned substantially parallel with the traveling direction of the boat 12 so as to increase the thrust of the boat 12.

After that, when, at the time t4, the speed ratio e is equal to or greater than the reference value erefa and the change amount DNIN is equal to or less than the prescribed value DNINref, the lockup clutch 44*d* is made ON (S124, S128, S130). At this time, a bit of the trim-up permitting flag is reset to 0 (S136).

Figure 16D:
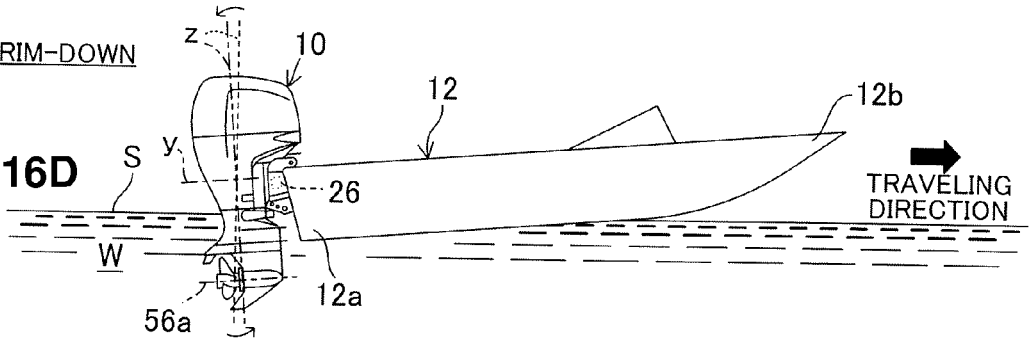

Then, when, at the time t5, it is determined that the throttle valve 38 is operated in the closing direction through the manipulation of the shift/throttle lever 102 by the operator, the lockup clutch 44*d* is made OFF, while a bit of the trim-down permitting flag is set to 1, so that the trim-down operation is started to return the trim angle θtrm to the initial angle (S106, S138, S144*a*, S300 to S304). The condition where the trim angle θtrm is returned to the initial angle is shown in FIG. 16D. At the time t6 at which the trim angle θtrm is returned to the initial angle, a bit of the trim-down permitting flag is reset to 0 (S302, S308).

As stated above, the second embodiment is configured to operate the power tilt-trim unit 26 to regulate the trim angle θtrm to the predetermined angle θtrm1 when the speed ratio e is equal to or greater than the predetermined value erefb. Since the predetermined value erefb can be set to a value of immediately before the lockup clutch 44*d* is made ON after the acceleration is completed and the predetermined angle θtrm1 can be set to a value enabling to increase the thrust of the boat 12 to trim up the outboard motor 10, it becomes possible to trim up the outboard motor 10 to increase the boat speed before the lockup clutch 44*d* is made ON. As a result, similarly to the first embodiment, the deceleration feel given to the operator can be avoided or mitigated.

Further, it is configured to operate the power tilt-trim unit 26 to return the trim angle θtrm to the initial angle when the throttle valve 38 is determined to be operated in the closing direction after the trim angle θtrm is regulated to the predetermined angle θtrm1. With this, the trim angle θtrm at the predetermined angle θtrm1 can be returned to the initial angle at the appropriate timing in accordance with the operating condition of the outboard motor 10 and it becomes possible to eliminate the process of manual operation of the power tilt-trim switch 106 by the operator (i.e., the trim-down operation). Further, since the trim angle θtrm is returned to the initial angle, when regulating the trim angle θtrm next time, the regulation can start from the initial angle, i.e., it is not needed to detect the current trim angle θtrm, thereby reliably and easily regulate the trim angle θtrm to the predetermined angle θtrm1.

It is configured to make the lockup clutch 44*d* ON when the change amount DNIN is equal to or less than the prescribed value DNINref after the trim angle θtrm is regulated to the predetermined angle θtrm1. With this, it becomes possible to accurately detect the time that the acceleration is completed and, since the lockup clutch 44*d* is made ON upon the completion of acceleration, speed performance can be enhanced.

The remaining configuration is the same as that in the first embodiment.

An outboard motor control apparatus according to a third embodiment of the invention will be explained.

Figure 17:
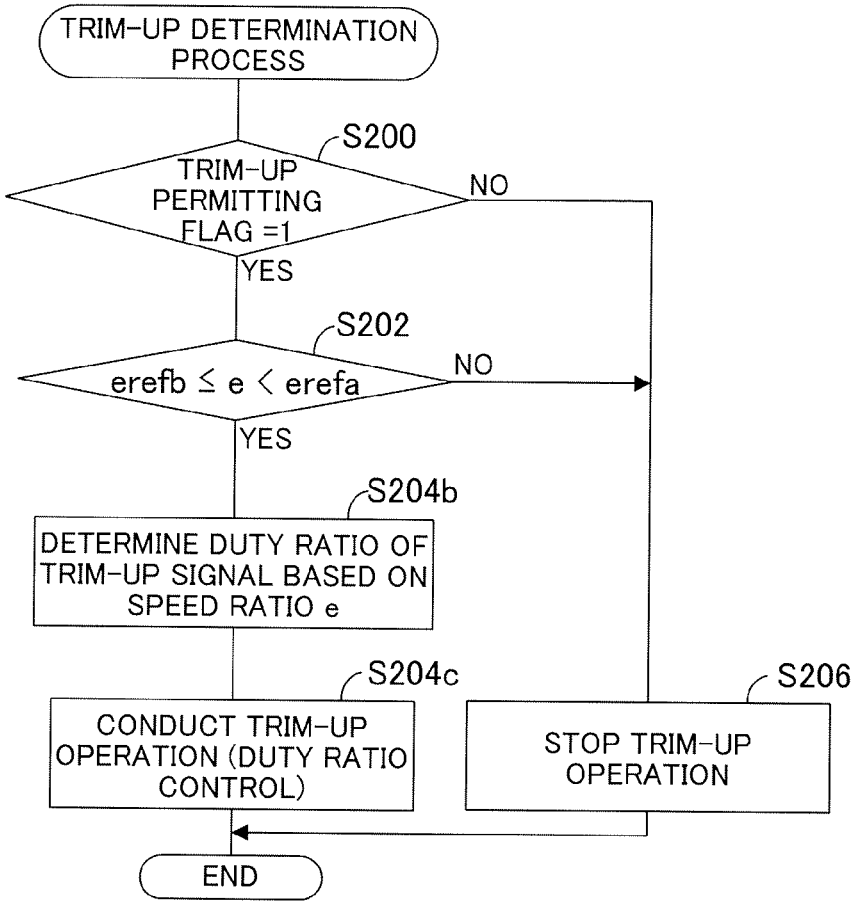
FIG. 17 is a subroutine flowchart similar to FIG. 8, but showing an alternative example of the trim-up determination process of FIG. 6 in the control of an electronic control unit of an outboard motor control apparatus according to a third embodiment of the invention.

FIG. 17 is a subroutine flowchart similar to FIG. 8, but showing an alternative example of the trim-up determination process of FIG. 6 in the first embodiment. In FIG. 17, the same steps as those in the FIG. 8 flowchart are applied with the same step numbers and the explanation thereof will be omitted.

The explanation will be made with focus on points of difference from the first embodiment.

Figure 18:
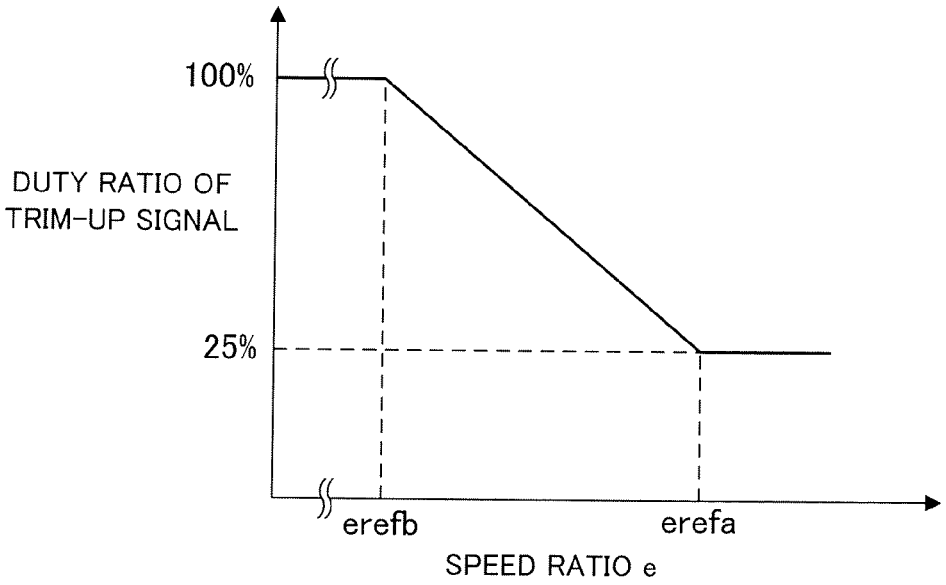
FIG. 18 is a graph showing the table characteristics of a duty ratio of a trim-up signal relative to a speed ratio of the torque converter, which is used in the processing of the FIG. 17 flowchart.

After the processing of S200 and S202, when the result in S202 is affirmative, the program proceeds to S204*b*, in which a duty ratio of a trim-up signal is determined based on the speed ratio e of the torque converter 44. Since the speed of trimming up is substantially proportional to the duty ratio of the trim-up signal, the processing of S204*b* amounts to determining the trim-up speed. This processing is conducted by retrieving table values shown in FIG. 18 using the speed ratio e. FIG. 18 is a graph showing the table characteristics of the duty ratio of the trim-up signal relative to the speed ratio e.

As illustrated, the duty ratio is defined to be inversely proportional to the speed ratio e of the torque converter 44, i.e., to decrease with increasing speed ratio e. To be specific, the duty ratio e is 100 percent when the speed ratio e is the predetermined value erefb and is 25 percent when the speed ratio is the reference value erefa.

The program proceeds to S204*c*, in which the power tilt-trim unit 26 is operated using the determined duty ratio to trim up the outboard motor 10, i.e., the trim-up operation is conducted or started at predetermined speed corresponding to the duty ratio.

The predetermined speed is explained in detail. When the speed ratio e is the predetermined value erefb, i.e., when the trim-up operation is started, since the duty ratio is 100 percent, the predetermined speed (initial speed) is set to a relatively high value.

After that, as the speed ratio e is increased/decreased, the predetermined speed is changed in accordance therewith. Specifically, when the acceleration is continued, as the speed ratio e is increased and becomes closer to the reference value erefa, i.e., as the acceleration approaches the end, the duty ratio is gradually decreased and hence, the predetermined speed is gradually decreased accordingly. Thus the trim-up operation of the outboard motor 10 is started at relatively high predetermined speed and the speed is decreased with increasing speed ratio e.

Returning to the explanation on FIG. 17, in a program loop after starting the trim-up operation in S204*c*, when the speed ratio e reaches the reference value erefa, the result in S202 is negative and the program proceeds to S206, in which the trim-up operation is stopped.

Owing to this configuration, before the lockup clutch 44*d* is made ON, the power tilt-trim unit 26 is operated to start the trim-up operation so that the thrust of the boat 12 can be increased to increase the boat speed.

Figure 19:
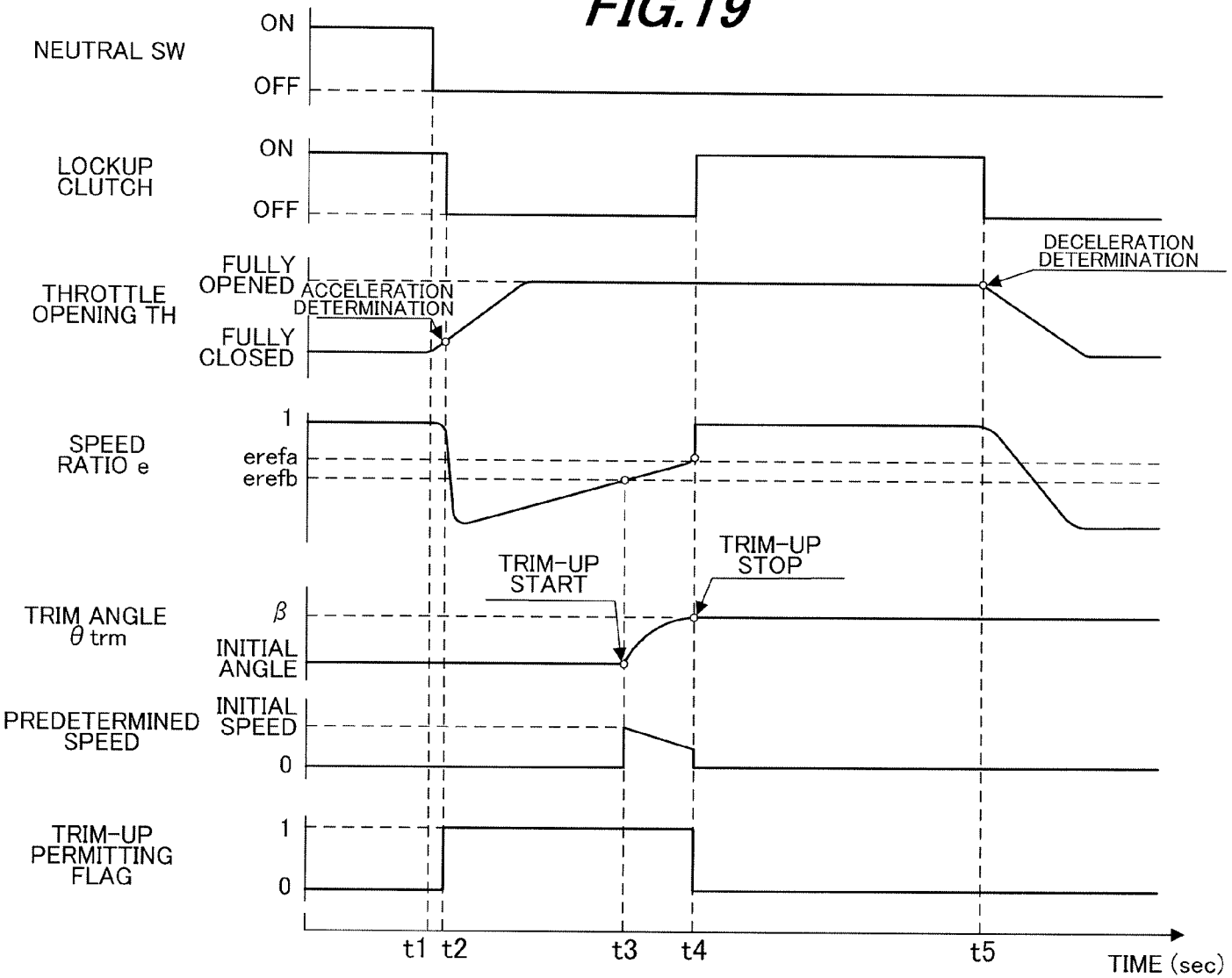
FIG. 19 is a time chart similar to FIG. 9, but explaining the processing of the FIG. 17 flowchart.

FIG. 19 is a time chart similar to FIG. 9, but explaining the foregoing processing. The explanation on the FIG. 19 time chart will be made with reference to FIGS. 10A to 10C. The explanation with respect to the time t1 and time t2 is the same as the first embodiment, so it is omitted here.

After the time t2, when the acceleration is continued and the speed ratio e becomes equal to or greater than the predetermined value erefb (at the time t3), the trim-up operation is started at the predetermined speed (initial speed) (S202 to S204*c*). Then, as shown at the time t3 to time t4, the predetermined speed is changed to decrease with increasing speed ratio e.

When the speed ratio reaches the reference value erefa at the time t4, the trim-up operation is stopped and the lockup clutch 44*d* is made ON (S124, S130, S202, S206). At this time, a bit of the trim-up permitting flag is reset to 0 (S136).

FIG. 10C is a view showing a condition where the trim angle θtrm is regulated to the angle β and the bow 12*b* is moved down by stopping the trim-up operation. As clearly shown, since the trim-up operation is stopped to regulate the trim angle θtrm to the angle β, the boat speed can be increased.

The processing at the time t5 is the same as in the first embodiment.

As stated above, since the third embodiment is configured to operate the power tilt-trim unit 26 to start the trim-up operation at the predetermined speed when the speed ratio e is equal to or greater than the predetermined value erefb, similarly to the first embodiment, the deceleration feel given to the operator can be avoided or mitigated.

Further, since it is configured to start the trim-up operation at the predetermined speed and change the predetermined speed in accordance with increase/decrease of the speed ratio e, it becomes possible to determine the condition of the boat 12 (e.g., whether the boat 12 is in the bow down position) based on the speed ratio e and conduct the trim-up operation at the trim-up speed appropriate to the boat 12 condition, thereby preventing the pitching of the boat 12.

It is configured to decrease the predetermined speed (trim-up speed) with increasing speed ratio e (i.e., as the acceleration approaches the end). With this, it becomes possible to conduct the trim-up operation at the trim-up speed appropriate to the boat 12, thereby reliably preventing the pitching of the boat 12.

The remaining configuration is the same as that in the first embodiment.

An outboard motor control apparatus according to a fourth embodiment of the invention will be explained.

In the fourth embodiment, in addition to the configuration described in the above embodiments, an acceleration sensor 110 is installed in the center of gravity of the boat 12 near the cockpit 92, as indicated by imaginary lines in FIG. 1, to detect the acceleration acting on the boat 12. The acceleration sensor 110 produces an output or signal indicative of the acceleration acting on the boat 12 in the vertical (gravity axis) direction or the like. The output of this sensor 110 is also sent to the ECU 90.

Figure 20:
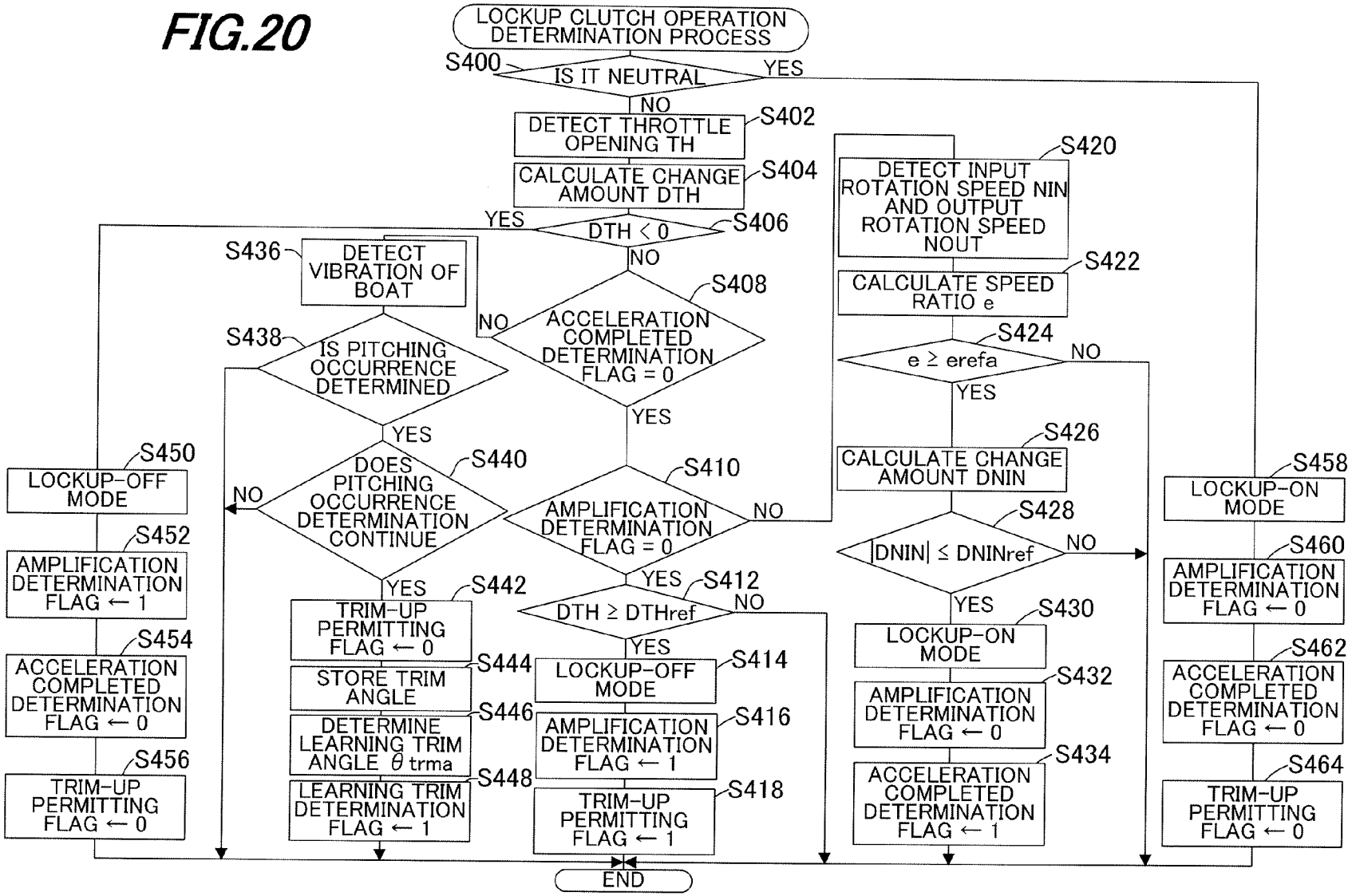
FIG. 20 is a subroutine flowchart similar to FIG. 7, but showing an alternative example of the lockup clutch operation determination process of FIG. 6 in the control of an electronic control unit of an outboard motor control apparatus according to a fourth embodiment of the invention.

FIG. 20 is a subroutine flowchart similar to FIG. 7, but showing an alternative example of the lockup clutch operation determination process of FIG. 6.

The processing of S400 to S434 is conducted similarly to that of S100 to S134 of the FIG. 7 flowchart.

When a bit of the torque converter acceleration completed determination flag is set to 1 in S434, the result in S408 in the next and subsequent loops is negative and the program proceeds to S436, in which the vibration of the boat 12 in the vertical direction is detected, specifically, it is detected by detecting or calculating vibration acceleration G acting on the boat 12 in the vertical direction based on the output of the acceleration sensor 110.

The program proceeds to S438, in which it is determined whether the pitching of the boat 12 occurs, i.e., whether the detected vibration, precisely an absolute value of the vibration acceleration G is within a permissible range. The permissible range is set to a range (e.g., 0 to 0.2 G) enabling to determine that the vertical vibration of the boat 12 is relatively small and no pitching occurs.

When the result in S438 is negative, i.e., when the vibration is within the permissible range and no pitching occurs, the remaining steps are skipped and when the result is affirmative (i.e., the vibration is out of the permissible range and the pitching occurs), the program proceeds to S440, in which it is determined whether the determination of pitching occurrence is successively made. It is determined by, when the pitching occurrence is determined in S438, incrementing a counter (whose initial value is 0) by 1 in another program (not shown) and checking whether the count value reaches a multiple (i.e., two) times.

Since the first processing of S440 is conducted immediately after the affirmative result is made in S438, the result in S440 is negative and the remaining steps are skipped. When it is again determined that the pitching occurs in S438 in the next program loop, the result in S440 is affirmative, i.e., it is determined that the pitching surely occurs and in S442, a bit of the trim-up permitting flag is reset to 0.

In S444, based on the output of the trim angle sensor 88, the current trim angle θtrm is detected or calculated, i.e., the trim angle θtrm of at the time when the pitching occurs is detected and stored, and in S446, a value obtained by subtracting a predetermined angle (e.g., 2 degrees) from the stored trim angle θtrm is determined as a learning trim angle θtrma (explained later).

In S448, a bit of the learning trim determination flag (whose initial value is 0) is set to 1. Setting this flag to 1 means that the pitching of the boat 12 occurs and the learning trim angle θtrma is determined.

When the result in S406 is affirmative, the program proceeds to S450, and the processing until S456 is conducted similarly to that of S138 to S144 of the FIG. 7 flowchart.

Figure 21:
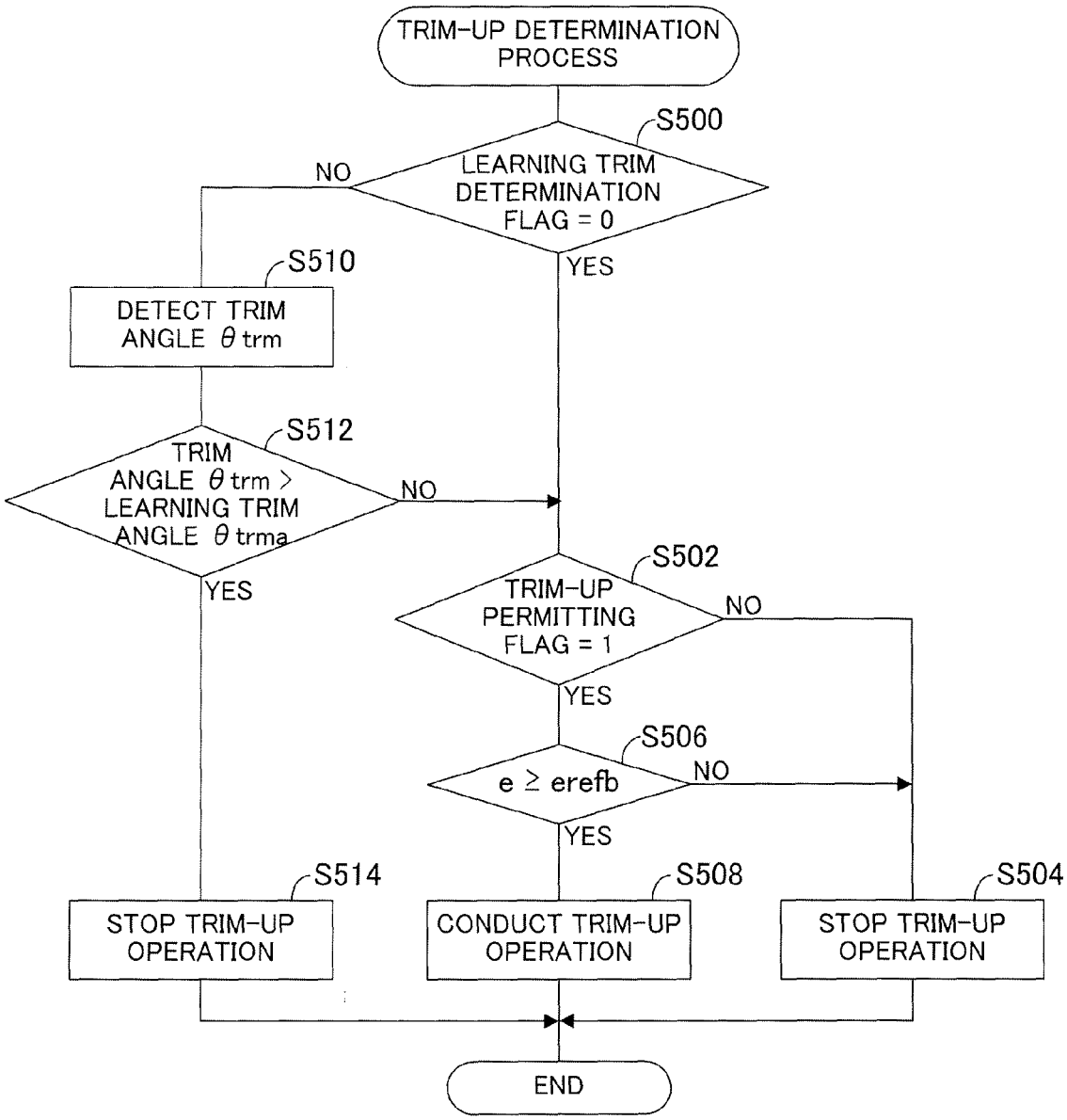
FIG. 21 is a subroutine flowchart showing an alternative example of the trim-up determination process of FIG. 6.

FIG. 21 is a subroutine flowchart showing an alternative example of the trim-up determination process of the FIG. 6 flowchart. In S500, it is determined whether a bit of the learning trim determination flag is 0. Since the initial value of this flag is 0, the processing of S500 in the first program loop is affirmative and the program proceeds to S502, in which it is determined whether a bit of the trim-up permitting flag is 1.

When the result in S502 is negative, the program proceeds to S504, in which the trim-up operation is stopped, while, when the result is affirmative, proceeding to S506, in which it is determined whether it is immediately before the end of the torque amplification range of the torque converter 44. When the speed ratio e of the torque converter 44 is equal to or greater than the predetermined value erefb, the result in S506 becomes affirmative.

When the result in S506 is negative, since it is not the time to start the trim-up operation, the program proceeds to S504 described above, whereafter the program is terminated without conducting the trim-up operation. On the other hand, when the result is affirmative, the program proceeds to S508, in which the power tilt-trim unit 26 is operated to start and conduct the trim-up operation.

Owing to this configuration, before the lockup clutch 44*d* is made ON, the power tilt-trim unit 26 is operated to start the trim-up operation so that the thrust of the boat 12 can be increased to increase the boat speed.

In S506, similarly to S202 of the FIG. 8 flowchart in the first embodiment, it is also determined whether the power tilt-trim switch 106 produces a signal indicative of a trim angle regulation command or the like, and when the signal is produced and inputted, the power tilt-trim unit 26 is operated in accordance with the inputted signal.

When the result in S500 is negative, i.e., when the pitching of the boat 12 occurs and the learning trim angle θtrma is determined, the program proceeds to S510, in which the trim angle θtrm is detected and to S512, in which it is determined whether the detected trim angle θtrm exceeds the learning trim angle θtrma.

Since the learning trim angle θtrma is obtained by subtracting the predetermined angle from the trim angle θtrm of at the time when the pitching occurs as explained with respect to S446, the result in S512 of the first program loop is naturally affirmative and the program proceeds to S514, in which the trim-up operation is stopped. Thus, when the boat vibration is out of the permissible range and it is determined that the pitching of the boat 12 occurs, the trim-up operation is stopped.

In the case where, after stopping the trim-up operation, the outboard motor 10 is trimmed down through, for example, the manipulation of the power tilt-trim switch 106 by the operator so that the trim angle θtrm becomes the initial angle (i.e., 0 degree), since a bit of the learning trim determination flag has been already set to 1, the result in S500 in the next and ensuing program loops is negative and the program proceeds to S510 and S512.

When the trim angle θtrm is at the initial angle, the result in S512 is negative and the program proceeds to the processing of S502 to S508 to determine whether the trim-up operation should be conducted based on the moving direction of the throttle valve 38 and the speed ratio e. In the case where the trim-up operation is started, when the trim angle θtrm reaches the learning trim angle θtrma after starting trimming up, the result in S512 is affirmative and the trim-up operation is stopped.

Thus, when the pitching of the boat 12 occurs, the trim-up operation is stopped. In addition, the learning trim angle θtrma is determined to be near the trim angle θtrm stored in S444, and after next trim-up operation is started, when the trim angle θtrm reaches the learning trim angle θtrma, the trim-up operation is stopped.

Figure 22:
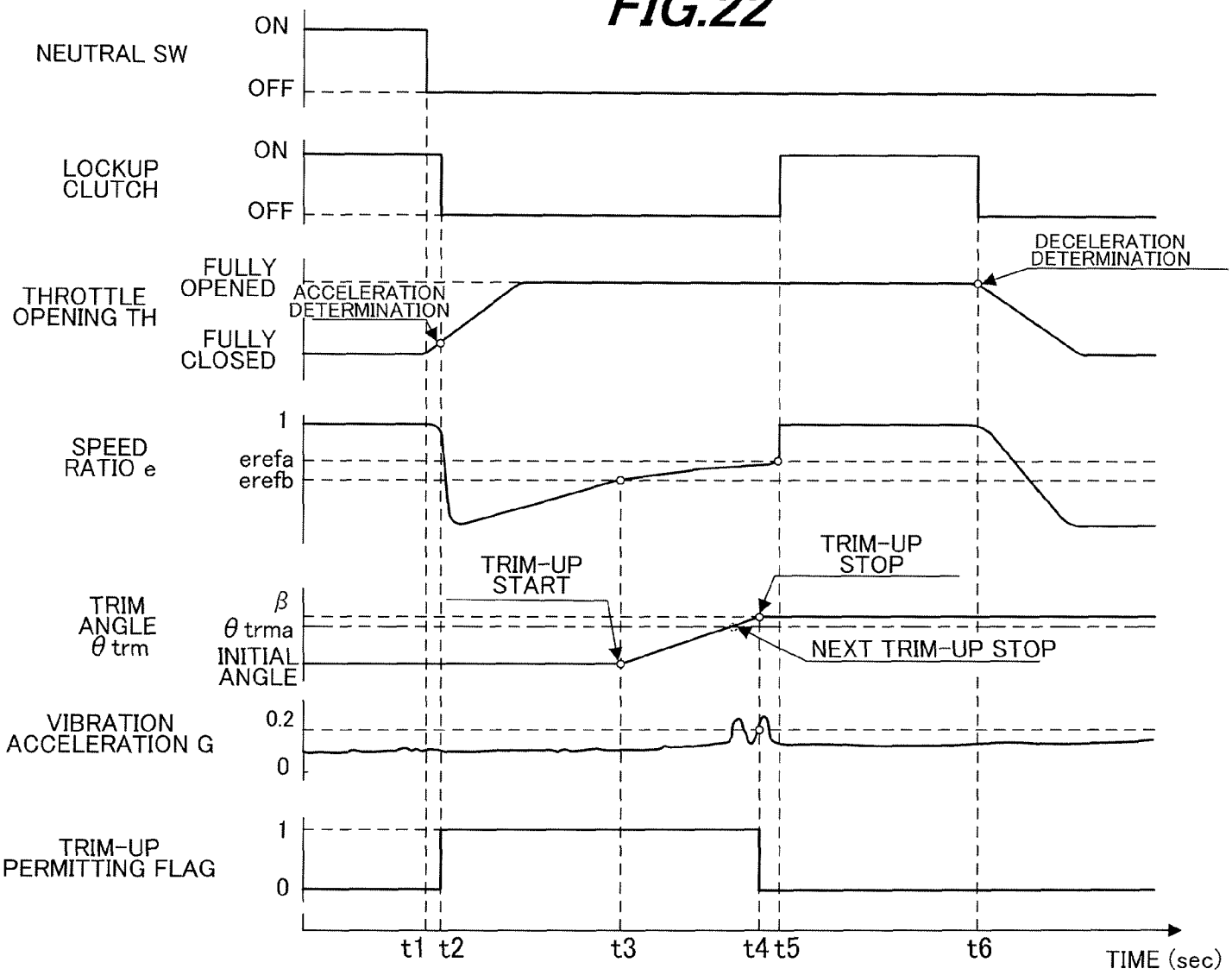
FIG. 22 is a time chart similar to FIG. 9, but explaining the processing of the flowcharts of FIGS. 21 and 22.
Figure 23A:
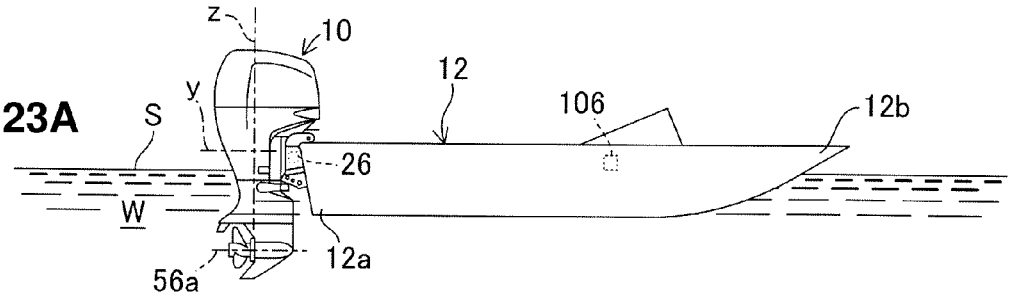
FIGS. 23A to 23C are explanatory views similar to FIGS. 10A to 10C, but explaining the processing of the flowcharts of FIGS. 21 and 22.
Figure 23B:
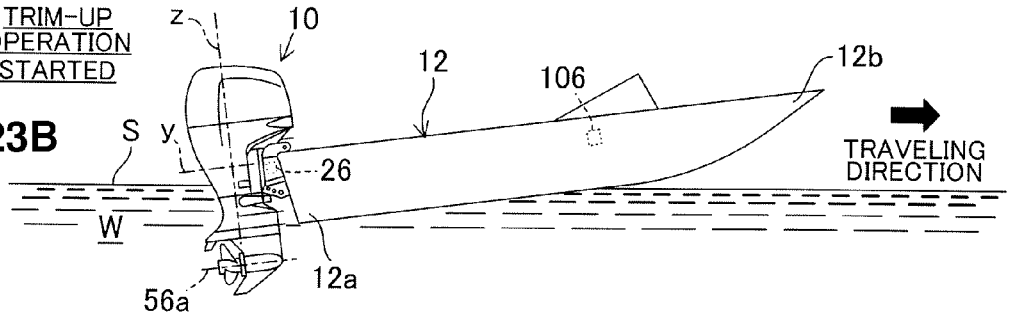
Figure 23C:
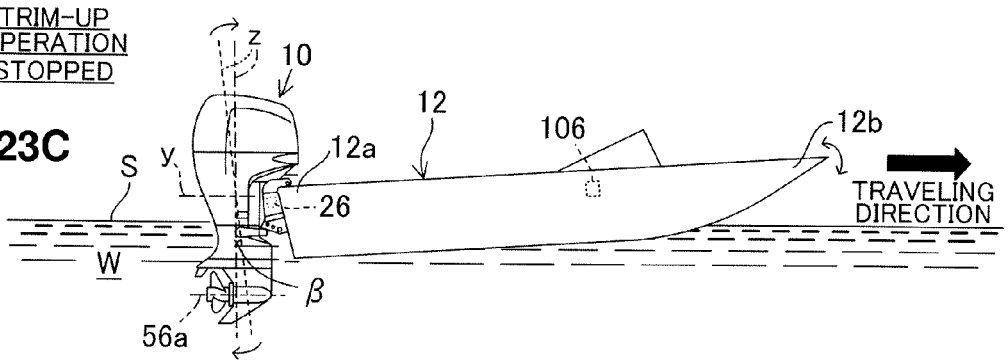

FIG. 22 is a time chart similar to FIG. 9, but explaining the foregoing processing and FIGS. 23A to 23C are explanatory views thereof, similar to FIGS. 10A to 10C. The explanation on the FIG. 22 time chart will be made with reference to FIGS. 23A to 23C. The explanation with respect to the time t1 and time t2 is the same as the first embodiment, so it is omitted here.

After the time t2, when the acceleration is continued and the speed ratio e becomes equal to or greater than the predetermined value erefb (at the time t3), the trim-up operation is started (S506, S508).

When, at the time t4, it is determined that the vibration acceleration G is out of the permissible range, i.e., exceeds 0.2 G, and the pitching of the boat 12 occurs, the trim-up operation is stopped (S436 to S448, S500, S510 to S514). A bit of the trim-up permitting flag is reset to 0 at the time t4 (S442). When, at the time t5, the speed ratio e reaches the reference value erefa, the lockup clutch 44*d* is made ON (S424, S430).

FIG. 23 is a view showing a condition where the trim-up operation is stopped and the trim angle θtrm is at the angle β. As clearly shown, since the outboard motor 10 is trimmed up to regulate the trim angle θtrm, the boat speed can be increased.

After that, when, at the time t6, it is determined that the throttle valve 38 is operated in the closing direction (the boat 12 is in the decelerating condition) through the manipulation of the shift/throttle lever 102 by the operator, the lockup clutch 44*d* is made OFF (S406, S450).

In the case where the next trim-up operation is started, since a value obtained by subtracting the predetermined angle from the trim angle θtrm (i.e., the angle β of at the time t4 when the pitching occurs is determined as the learning trim angle θtrma (indicated by the imaginary lines in FIG. 22) as explained above, when the trim angle θtrm reaches the learning trim angle θtrma, the trim-up operation is stopped.

As stated above, since the fourth embodiment is configured to operate the power tilt-trim unit 26 to start the trim-up operation when the speed ratio e is equal to or greater than the predetermined value erefb, similarly to the first embodiment, the deceleration feel given to the operator can be avoided or mitigated.

Further, it is configured to detect vibration (vibration acceleration G) acting on the boat 12 in the vertical direction of the boat 12, determine whether the detected vibration is in the permissible range, and stop the trim-up operation when the vibration is determined to be out of the range. In other words, based on the vertical vibration of the boat 12, it is determined whether the pitching occurs, and when the vibration is out of the range so that the pitching occurrence is determined, the trim-up operation is stopped. With this, the trim-up operation can be stopped immediately after the pitching occurs and hence, the trim angle after the trim-up operation can be set to an optimal value for the boat 12, while suppressing the pitching of the boat 12 to the minimum.

Further, it is configured to store in a memory the trim angle (angle 13) of at the time when the vibration is determined to be out of the permissible range and the trim-up operation is stopped, and stop the trim-up operation when the current trim angle reaches the stored trim angle (learning trim angle θtrma) or thereabout after next trim-up operation is started. Specifically, since the trim angle at which the trim-up operation is to be stopped is stored to be used for the learning control, it becomes possible to set the trim angle of after starting the next trim-up operation to an optimal value, thereby preventing the pitching of the boat 12.

Further, since it is configured to detect the vibration based on the output of the acceleration sensor 110 installed in the boat 12, the pitching of the boat 12 can be more accurately detected.

The remaining configuration is the same as that in the first embodiment.

As mentioned in the foregoing, in the first to fourth embodiments, it is configured to have an apparatus for and a method of controlling operation of an outboard motor (10) mounted on a stern (12*a*) of a boat (12) and having an internal combustion engine (30) to power a propeller (60), a drive shaft (42) connecting the engine and the propeller, and a torque converter (44) equipped with a lockup clutch (44*d*) and interposed between the engine and the drive shaft, comprising: a trim angle regulator (power tilt/trim unit 26) that regulates a trim angle (θtrm) relative to the boat by trim-up operation and trim-down operation; a speed ratio calculator (ECU 90, S10, S10*a*, S120, S122, 5420, 5422) that calculates a speed ratio (e) of the torque converter based on an input rotation speed (NIN) and output rotation speed (NOUT) of the torque converter; and a trim angle regulator controller (ECU 90) that controls operation of the trim angle regulator based on the calculated speed ratio.

In the first embodiment, in the apparatus and method, the trim angle regulator controller controls operation of the trim angle regulator to start the trim-up operation when the speed ratio is equal to or greater than a predetermined value (erefb) and to stop the trim-up operation when the speed ratio reaches a reference value (erefa) set greater than the predetermined value (S12, S202 to S206), and controls operation of the lockup clutch to ON when the speed ratio reaches the reference value (S10, S124, S130).

The apparatus and method further includes a throttle valve operation direction determiner (ECU 90, S10, S112) that determines whether a throttle valve (38) of the engine is operated in an opening direction, and the trim angle regulator controller starts the trim-up operation when the throttle valve is determined to be operated in the opening direction and when the speed ratio is equal to or greater than the predetermined value (S200 to S204).

In the second embodiment, the apparatus and method further includes a throttle valve operation direction determiner (ECU 90, S10*a*, S106) that determines whether a throttle valve of the engine is operated in a closing direction, and the trim angle regulator controller operates the trim angle regulator to regulate the trim angle to a predetermined angle (θtrm1) when the speed ratio is equal to or greater than a predetermined value, and to return the trim angle to an initial angle when the throttle valve is determined to be operated in the closing direction after the trim angle is regulated to the predetermined angle (S10*a* to S14, S106, S144*a*, S202*a*, s204*a*. S300 to S304).

The apparatus and method further includes a clutch controller (ECU 90, S10*a*, S128, S130) that controls operation of the lockup clutch to ON when a change amount (DNIN) of the input rotation speed is equal to or less than a prescribed value (DNINref) after the trim angle is regulated to the predetermined angle by the trim angle regulator controller.

In the third embodiment, in the apparatus and method, the trim angle regulator controller operates the trim angle regulator to start the trim-up operation at predetermined speed when the speed ratio is equal to or greater than a predetermined value and changes the predetermined speed in accordance with increase/decrease of the speed ratio (S12, S202 to S204*c*).

In the apparatus and method, the trim angle regulator controller decreases the predetermined speed with increasing speed ratio (S204*b*).

The apparatus and method further includes a throttle valve operation direction determiner (ECU 90, S10, S112) that determines whether a throttle valve of the engine is operated in an opening direction, and the trim angle regulator controller starts the trim-up operation when the throttle valve is determined to be operated in the opening direction and when the speed ratio is equal to or greater than the predetermined value (S200 to S204*c*).

In the fourth embodiment, the apparatus and method further includes a vibration determiner (ECU 90, acceleration sensor 110, S10, S436 to S440) that detects vibration acting on the boat in a vertical direction of the boat and determines whether the detected vibration is in a permissible range, and the trim angle regulator controller operates the trim angle regulator to start the trim-up operation when the speed ratio is equal to or greater than a predetermined value and to stop the trim-up operation when the vibration is determined to be out of the permissible range (S12, S500 to S514).

In the apparatus and method, the trim angle regulator controller stores in a memory the trim angle (angle β) of at time when the vibration is determined to be out of the permissible range and the trim-up operation is stopped, and stops the trim-up operation when a current trim angle reaches the stored trim angle (learning trim angle θtrma) or thereabout after next trim-up operation is started (S10, S12, S444, S446, S500, S510 to S514).

In the apparatus and method, the vibration determiner detects the vibration based on an output of an acceleration sensor (110) installed in the boat (S10, S416).

In the first to fourth embodiments, the apparatus and method further includes a switch (power tilt-trim switch 106) installed to be manipulated by an operator, and the trim angle regulator controller controls operation of the trim angle regulator when the switch is manipulated (S12, S202).

It should be noted that, although the reference value erefa, predetermined values erefb, predetermined angle θtrm1, prescribed value DNINref, displacement of the engine 30 and other values are indicated with specific values in the foregoing, they are only examples and not limited thereto.

Japanese Patent Application Nos. 2009-101157, 2009-101158, 2009-101159 and 2009-101160, all filed on Apr. 17, 2009 are incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor mounted on a stern of a boat and having an internal combustion engine to power a propeller, a drive shaft connecting the engine and the propeller, and a torque converter equipped with a lockup clutch and interposed between the engine and the drive shaft, comprising:

a trim angle regulator that regulates a trim angle relative to the boat by trim-up operation and trim-down operation;

a speed ratio calculator that calculates a speed ratio of the torque converter based on an input rotation speed and output rotation speed of the torque converter; and a trim angle regulator controller that controls operation of the trim angle regulator based on the calculated speed ratio, wherein the trim angle regulator controller controls operation of the trim angle regulator to start the trim-up operation when the speed ratio is equal to or greater than a predetermined value and to stop the trim-up operation when the speed ratio reaches a reference value set greater than the predetermined value, and controls operation of the lockup clutch to ON when the speed ratio reaches the reference value.

2. The apparatus according to claim 1, further including:

a throttle valve operation direction determiner that determines whether a throttle valve of the engine is operated in an opening direction, and the trim angle regulator controller starts the trim-up operation when the throttle valve is determined to be operated in the opening direction and when the speed ratio is equal to or greater than the predetermined value.

3. An apparatus for controlling operation of an outboard motor mounted on a stern of a boat and having an internal combustion engine to power a propeller, a drive shaft connecting the engine and the propeller, and a torque converter equipped with a lockup clutch and interposed between the enginee and the drive shaft, comprising:

a trim angle regulator that regulates a trim angle relative to the boat by trim-up operation and trim-down operation;

a speed ratio calculator that calculates a speed ratio of the torque converter based on an input rotation speed and output rotation speed of the torque converter;

a trim angle regulator controller that controls operation of the trim angle regulator based on the calculated speed ratio; and a throttle valve operation direction determiner that determines whether a throttle valve of the engine is operated in a closing direction, and the trim angle regulator controller operates the trim angle regulator to regulate the trim angle to a predetermined angle when the speed ratio is equal to or greater than a predetermined value, and to return the trim angle to an initial angle when the throttle valve is determined to be operated in the closing direction after the trim angle is regulated to the predetermined angle.

4. The apparatus according to claim 3, further including:

a clutch controller that controls operation of the lockup clutch to ON when a change amount of the input rotation speed is equal to or less than a prescribed value after the trim angle is regulated to the predetermined angle by the trim angle regulator controller.

5. An apparatus for controlling operation of an outboard motor mounted on a stern of a boat and having an internal combustion engine to power a propeller, a drive shaft connecting the engine and the propeller, and a torque converter equipped with a lockup clutch and interposed between the engine and the drive shaft, comprising:

a trim angle regulator that regulates a trim angle relative to the boat by trim-up operation and trim-down operation;

a speed ratio calculator that calculates a speed ratio of the torque converter based on an input rotation speed and output rotation speed of the torque converter; and a trim angle regulator controller that controls operation of the trim angle regulator based on the calculated speed ratio, wherein the trim angle regulator controller operates the trim angle regulator to start the trim-up operation at predetermined speed when the speed ratio is equal to or greater than a predetermined value and changes the predetermined speed in accordance with increase/decrease of the speed ratio.

6. The apparatus according to claim 5, wherein the trim angle regulator controller decreases the predetermined speed with increasing speed ratio.

7. The apparatus according to claim 5, further including:

a throttle valve operation direction determiner that determines whether a throttle valve of the engine is operated in an opening direction, and the trim angle regulator controller starts the trim-up operation when the throttle valve is determined to be operated in the opening direction and when the speed ratio is equal to or greater than the predetermined value.

8. An apparatus for controlling operation of an outboard motor mounted on a stern of a boat and having an internal combustion engine to power a propeller, a drive shaft connecting the engine and the propeller, and a torque converter equipped with a lockup clutch and interposed between the engine and the drive shaft, comprising:

a trim angle regulator that regulates a trim angle relative to the boat by trim-up operation and trim-down operation;

a speed ratio calculator that calculates a speed ratio of the torque converter based on an input rotation speed and output rotation speed of the torque converter;

a trim angle regulator controller that controls operation of the trim angle regulator based on the calculated speed ratio; and a vibration determiner that detects vibration acting on the boat in a vertical direction of the boat and determines whether the detected vibration is in a permissible range, and the trim angle regulator controller operates the trim angle regulator to start the trim-up operation when the speed ratio is equal to or greater than a predetermined value and to stop the trim-up operation when the vibration is determined to be out of the permissible range.

9. The apparatus according to claim 5, wherein the trim angle regulator controller stores in a memory the trim angle of at time when the vibration is determined to be out of the permissible range and the trim-up operation is stopped, and stops the trim-up operation when a current trim angle reaches the stored trim angle or thereabout after next trim-up operation is started.

10. The apparatus according to claim 5, wherein the vibration determiner detects the vibration based on an output of an acceleration sensor installed in the boat.

11. The apparatus according to claim 1, further including:

a switch installed to be manipulated by an operator, and the trim angle regulator controller controls operation of the trim angle regulator when the switch is manipulated.

12. The apparatus according to claim 3, further including:

a switch installed to be manipulated by an operator, and the trim angle regulator controller controls operation of the trim angle regulator when the switch is manipulated.

13. The apparatus according to claim 5, further including:

a switch installed to be manipulated by an operator, and the trim angle regulator controller controls operation of the trim angle regulator when the switch is manipulated.

14. The apparatus according to claim 8, further including:

a switch installed to be manipulated by an operator, and the trim angle regulator controller controls operation of the trim angle regulator when the switch is manipulated.

* * * * *

UNITED STATES PATENT AND TRADEMARK OFFICE

CERTIFICATE OF CORRECTION

PATENT NO. : 8,382,536 B2
APPLICATION NO. : 12/760273
DATED : February 26, 2013
INVENTOR(S) : Koji Kuriyagawa and Hajime Yoshimura It is certified that error appears in the above-identified patent and that said Letters Patent is hereby corrected as shown below:

In the claims:

Col. 22, Claim 9:
Line 1, change "according to claim 5" to --according to claim 8--

Col. 22, Claim 10:
Line 1, change "ccording to claim 5" to --according to claim 8--

Signed and Sealed this
Thirteenth Day of August, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,382,536 B2
APPLICATION NO. : 12/760273
DATED : February 26, 2013
INVENTOR(S) : Koji Kuriyagawa and Hajime Yoshimura It is certified that error appears in the above-identified patent and that said Letters Patent is hereby corrected as shown below:

In the claims:

Column 22, line 6 (Claim 9, Line 1) change “according to claim 5” to --according to claim 8--

Column 22, line 13 (Claim 10, Line 1) change “ccording to claim 5” to --according to claim 8--

This certificate supersedes the Certificate of Correction issued August 13, 2013.

Signed and Sealed this
Third Day of September, 2013

Teresa Stanek Rea
*Acting Director of the United States Patent and Trademark Office*